US010310435B2

(12) United States Patent
Taki

(10) Patent No.: US 10,310,435 B2
(45) Date of Patent: Jun. 4, 2019

(54) SHEET POST-PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Hiroyuki Taki, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 69 days.

(21) Appl. No.: 15/437,154

(22) Filed: Feb. 20, 2017

(65) Prior Publication Data

US 2017/0322508 A1 Nov. 9, 2017

(30) Foreign Application Priority Data

May 6, 2016 (JP) ..... 2016-093013

(51) Int. Cl.

| | |
|---|---|
| ***B65H 29/20*** | (2006.01) |
| ***B65H 31/36*** | (2006.01) |
| ***B65H 31/26*** | (2006.01) |
| ***G03G 15/00*** | (2006.01) |
| ***B65H 37/04*** | (2006.01) |

(52) U.S. Cl.

CPC ..... *G03G 15/6529* (2013.01); *B65H 29/20* (2013.01); *B65H 31/26* (2013.01); *B65H 31/36* (2013.01); *B65H 37/04* (2013.01); *G03G 15/6538* (2013.01); *B65H 2301/51611* (2013.01); *B65H 2404/1114* (2013.01); *B65H 2511/212* (2013.01); *B65H 2513/53* (2013.01); *B65H 2515/112* (2013.01); *B65H 2801/27* (2013.01)

(58) Field of Classification Search

CPC ..... B65H 29/20; B65H 2511/212; B65H 2404/1114; B65H 31/36

See application file for complete search history.

(56) References Cited

U.S. PATENT DOCUMENTS

| | | | |
|---|---|---|---|
| 6,220,592 | B1 | 4/2001 | Watanabe et al. |
| 7,043,192 | B2 | 5/2006 | Terao et al. |
| 7,215,922 | B2 | 5/2007 | Terao et al. |

(Continued)

FOREIGN PATENT DOCUMENTS

| | | | |
|---|---|---|---|
| JP | 2013-095533 | | 5/2013 |
| JP | 2013095533 A | * | 5/2013 |

OTHER PUBLICATIONS

U.S. Appl. No. 15/385,852, filed Dec. 20, 2016 (inventor Hiroyuki Taki).

(Continued)

*Primary Examiner* — Jennifer E Simmons
(74) *Attorney, Agent, or Firm* — Kim & Stewart LLP

(57) ABSTRACT

According to an embodiment, a sheet post-processing apparatus according to the embodiment includes a paddle member and a controller. The paddle member rotates around a rotating shaft, presses a plurality of sheets held on a processing tray against a stopper and aligns ends of the sheets in a sheet transport direction. After the ends of the sheets in the sheet transport direction are aligned, the controller further rotates the paddle member, and stops rotation of the paddle member in a state that the paddle member comes in contact with the sheets held on the processing tray.

9 Claims, 18 Drawing Sheets

(56) References Cited

U.S. PATENT DOCUMENTS

| | | | | |
|---|---|---|---|---|
| 7,286,792 | B2 | 10/2007 | Terao et al. | |
| 7,862,025 | B2 | 1/2011 | Sugizaki | |
| 7,997,577 | B2 | 8/2011 | Oshiro et al. | |
| 2008/0315492 | A1* | 12/2008 | Taki et al. | B42C 1/125 270/58.01 |
| 2009/0008872 | A1* | 1/2009 | Ryan | B65H 31/34 271/314 |
| 2011/0115152 | A1 | 5/2011 | Sugizaki | |
| 2014/0300047 | A1* | 10/2014 | Yamamoto | B65H 31/34 271/207 |

OTHER PUBLICATIONS

U.S. Appl. No. 15/218,700, filed Jul. 25, 2016 (inventor Hiroyuki Taki).
U.S. Appl. No. 15/218,688, filed Jul. 25, 2016 (inventor Hiroyuki Taki).
Extended European Search Report dated Oct. 2, 2017, filed in European counterpart Patent Application No. 17161473.8 (13 pages).

* cited by examiner

SHEET POST-PROCESSING APPARATUS

CROSS-REFERENCE TO RELATED APPLICATIONS

This application is based upon and claims the benefit of priority from the prior Japanese Patent Application No. 2016-093013, filed on May 6, 2016, the entire contents of which are incorporated herein by reference.

FIELD

An embodiment described here generally relates to a sheet post-processing apparatus, which performs post-processing on sheets on which images are formed.

BACKGROUND

In the related art, there is known a post-processing apparatus, which executes post-processing such as stapling processing on sheets stacked onto a processing tray. The sheet post-processing apparatus includes a lateral alignment member that aligns sheets misaligned in the width direction (lateral alignment processing) and a longitudinal alignment member that aligns the sheets misaligned in the direction that is orthogonal to the sheet width direction of the sheets (longitudinal alignment processing) in order to align misaligned sheets stacked onto the processing tray before the post-processing is performed. In particular, the sheet post-processing apparatus in the related art uses the longitudinal alignment member that rotates about a rotating shaft extending to the sheet width direction in order to clear the misalignment of sheets in the direction that is orthogonal to the width direction of the sheets.

However, in the sheet post-processing apparatus in the related art, there is a problem that once any external force is applied to the sheets after longitudinal alignment processing or lateral alignment processing are executed, the aligned sheets are misaligned.

DETAILED DESCRIPTION

According to one embodiment, a sheet post-processing apparatus includes a transport roller, a processing tray, a stopper, a paddle member, and a controller. The transport roller transports sheets. The processing tray holds the sheets transported by the transport roller. The stopper is disposed on an upstream side of the processing tray in a sheet transport direction. The paddle member rotates around a rotating shaft, and comes in contact with the sheets held on the processing tray. The rotating shaft is disposed in a sheet width direction of the sheets held on the processing tray, the sheet width direction is orthogonal to the sheet transport direction. The rotating paddle member comes in contact with the sheets held on the processing tray against the stopper and aligns ends of the sheets misaligned in the sheet transport direction. The controller stops rotation of the paddle member in a state that the paddle member comes in contact with the sheets held on the processing tray. Further, the controller drives the transport roller to transport subsequent sheets to the processing tray.

Hereinafter, a sheet post-processing apparatus of each embodiment will be described with reference to the drawings. It should be noted that in the following description, configurations having identical or similar functions are denoted by identical reference symbols, and description common thereto will sometimes be omitted.

Figure 1:
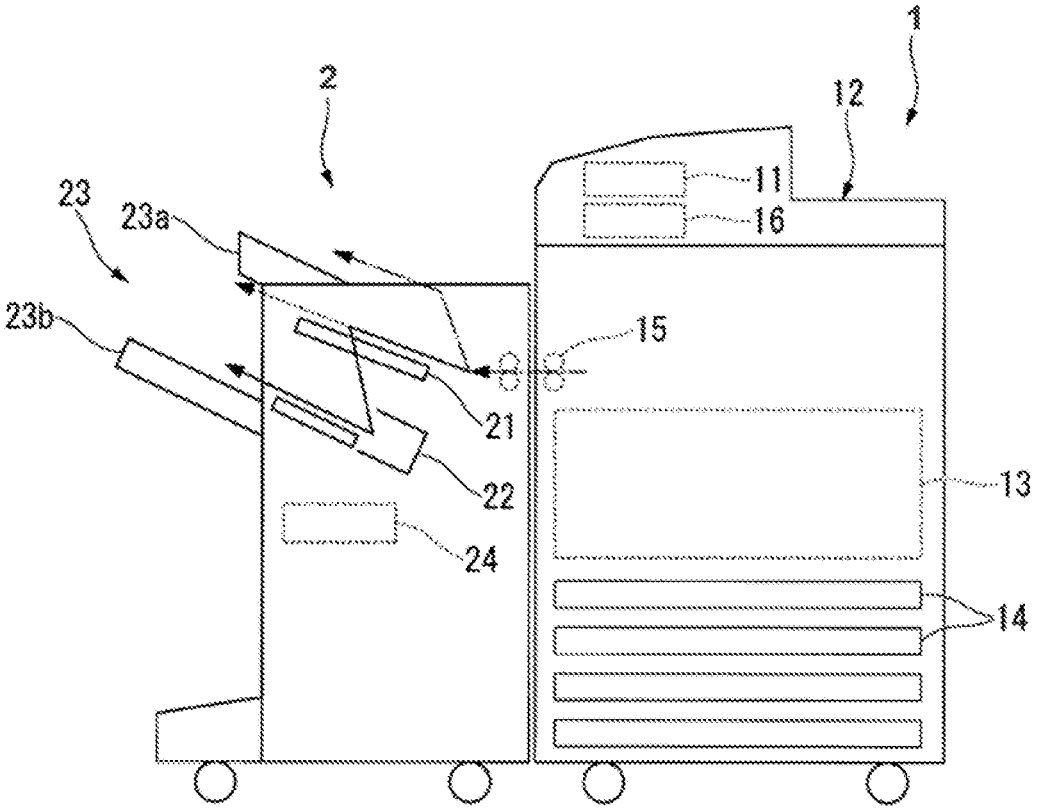
FIG. 1 is a view showing a configuration of an image-forming system according to a first embodiment.
Figure 2:
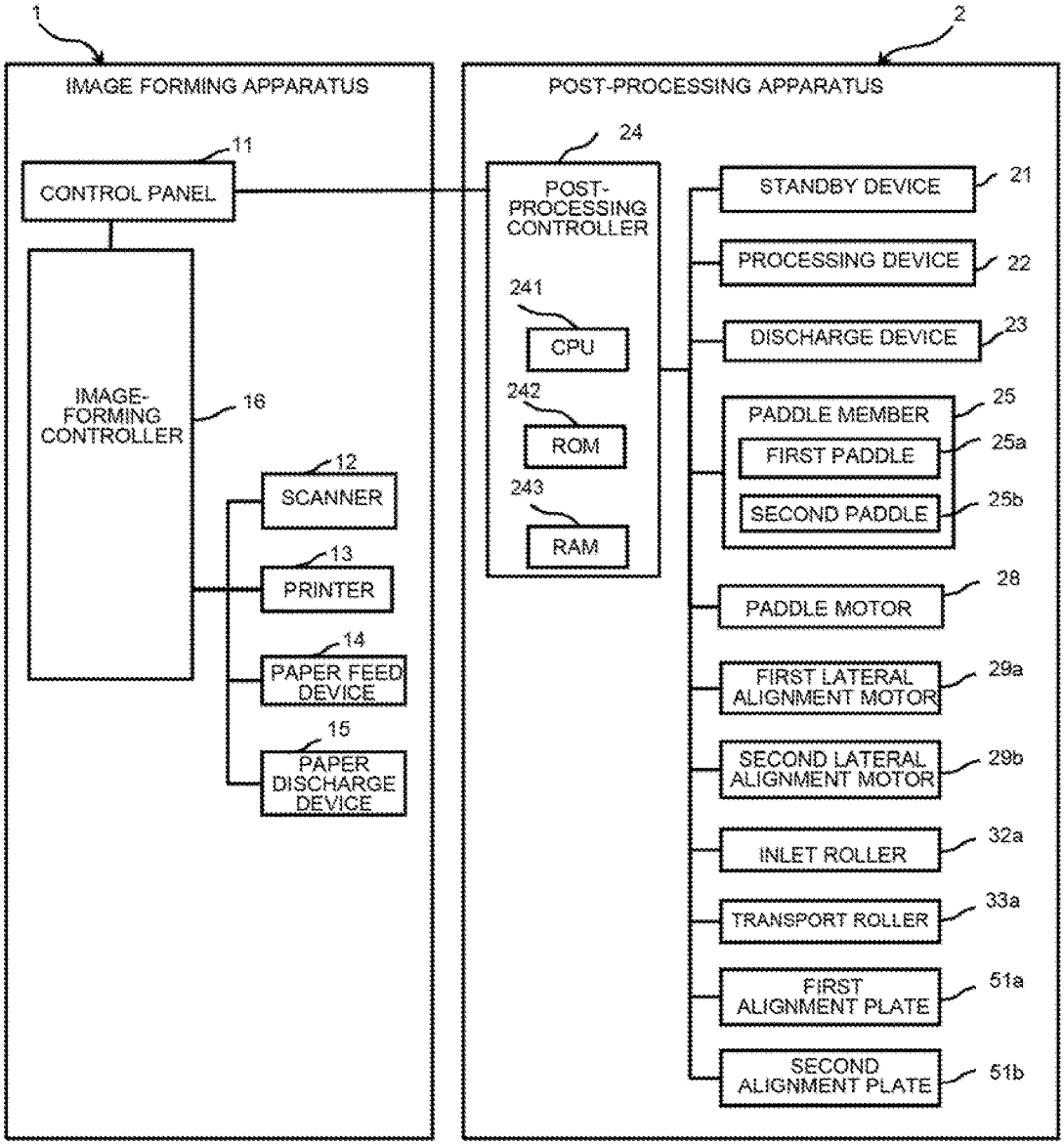
FIG. 2 is a block diagram showing an electric configuration of an image-forming apparatus and a sheet post-processing apparatus according to the first embodiment.

With reference to FIG. 1 to FIG. 15, a sheet post-processing apparatus of a first embodiment will be described. FIG. 1 is a view showing an overall configuration of the image-forming system. FIG. 2 is a block diagram showing an electric configuration of an image-forming apparatus 1 and a sheet post-processing apparatus 2. The image-forming system includes the image-forming apparatus 1 and the sheet post-processing apparatus 2. The image-forming apparatus 1 forms images on sheet-like media such as paper (hereinafter, described as "sheets"). The sheet post-processing apparatus 2 performs post-processing on the sheets transported from the image-forming apparatus.

The image-forming apparatus 1 shown in FIG. 1 includes a control panel 11, a scanner 12, a printer 13, a paper feed device 14, a paper discharge device 15, and an image-forming controller 16.

The control panel 11 includes various keys that receive user's operations. For example, the control panel 11 receives an input on a type of post-processing performed on sheets. The control panel 11 transmits information on the input type of post-processing to the post-processing apparatus 2.

The scanner 12 includes a read unit that reads image information of an object to be scanned. The scanner 12 transmits the read image information to the printer 13.

The printer 13 forms an output image (hereinafter, described as "toner image") on, for example, a photoreceptor by using a developer such as toner on the basis of the image information transmitted from the scanner 12 or an external device such as a client PC. The printer 13 transfers the toner image from a photoconductor to a sheet. The printer 13 applies heat and pressure to the toner image transferred onto the sheet, to fix the toner image onto the sheet.

The paper feed device 14 supplies a sheet to the printer 13 every time the printer 13 forms a toner image onto the photoconductor. The paper discharge device 15 transports the sheets, which are discharged from the printer 13, to the post-processing apparatus 2.

As shown in FIG. 2, the image-forming controller 16 controls an overall operation of the image-forming apparatus 1. In other words, the image-forming controller 16 controls the control panel 11, the scanner 12, the printer 13, the paper feed device 14, and the paper discharge device 15. The image-forming controller 16 is formed of a control circuit including a CPU (Central Processing Unit), a ROM (Read Only Memory), and a RAM (Random Access Memory) (not shown).

Next, the sheet post-processing apparatus 2 will be described with reference to FIG. 1 and FIG. 2. As shown in FIG. 1, the post-processing apparatus 2 is connected to the image-forming apparatus 1, and is disposed adjacently to the image-forming apparatus 1. The post-processing apparatus 2 executes the post-processing on sheets transported from the image-forming apparatus 1, the post-processing being specified via the control panel 11 or by an external device such as a client PC. For example, the post-processing includes stapling processing or sorting processing, for example.

The post-processing apparatus 2 includes a standby device 21, a processing device 22, a discharge device 23, and a post-processing controller 24. The standby device 21 temporarily retains (buffers) sheets S (see FIG. 3) transported from the image-forming apparatus 2. For example, the standby device 21 keeps a plurality of subsequent sheets S to be standby during post-processing performed on preceding sheets S by the processing device 22. The standby device 21 is provided above the processing device 22. When the sheets in the processing device 22 are discharged to the discharge device 23, then the standby device 21 drops the retained sheets S down to the processing device 22.

The processing device 22 performs post-processing on the sheets S. For example, the processing device 22 aligns the plurality of sheets S. The processing device 22 performs stapling processing on the plurality of aligned sheets S. As a result, the plurality of sheets S are bound together. The processing device 22 discharges the sheets S, which are subjected to the post-processing, to the discharge device 23.

The discharge device 23 includes a fixed tray 23*a* and a movable tray 23*b*. The fixed tray 23*a* is provided to an upper portion of the post-processing apparatus 2. The movable tray 23*b* is provided to a side portion of the post-processing apparatus 2. The sheets S that are subjected to the stapling processing or the sorting processing and then discharged are discharged to the movable tray 23*b*.

As shown in FIG. 2, the post-processing controller 24 controls an overall operation of the post-processing apparatus 2. In other words, the post-processing controller 24 controls the standby device 21, the processing device 22, and the discharge device 23. Further, as shown in FIG. 2, the post-processing controller 24 controls inlet rollers 32*a*, 32*b*, transport rollers 33*a*, 33*b*, paddle members 25, a paddle motor 28, a first lateral alignment motor 29*a*, a second lateral alignment motor 29*b*, a first alignment plate 51*a*, and a second alignment plate 51*b*. The post-processing controller 24 is a control circuit including a CPU 241, a ROM 242, and a RAM 243. Although in this embodiment, two motors of the first lateral alignment motor 29*a* and the second lateral alignment motor 29*b* are used, the respective alignment plates 51*a*, 51*b* may be moved by one motor.

Figure 3:
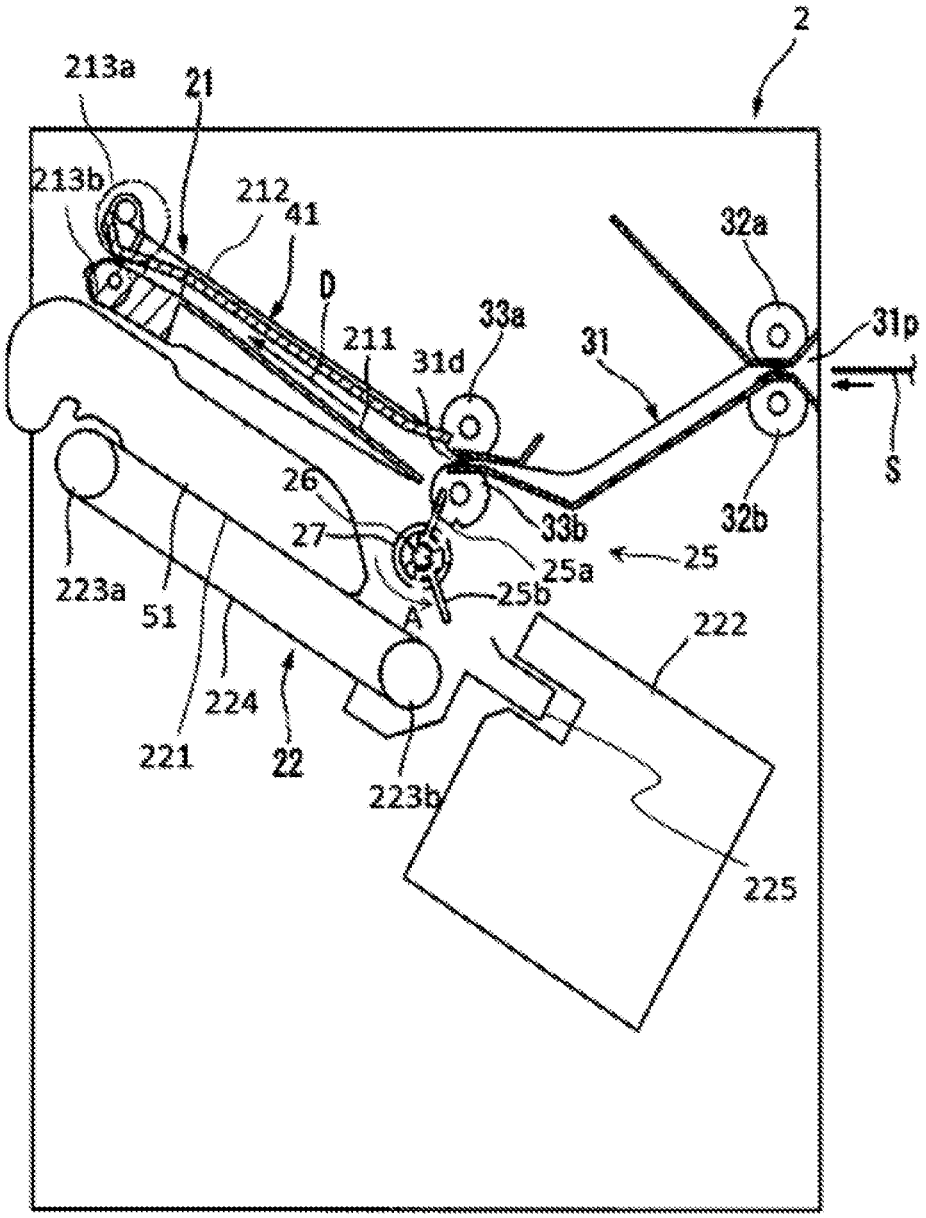
FIG. 3 is a cross-sectional view schematically showing a configuration of a sheet post-processing apparatus according to the first embodiment.

FIG. 3 is a view schematically showing a configuration of a sheet post-processing apparatus 2 in detail. It should be noted that in description on the following embodiments, a "sheet transport direction" means a transport direction D of the sheets S to a standby tray 211 of the standby device 21 (entry direction of the sheets S to the standby tray 211) or a transport direction of the sheets S from a processing tray 221 to the movable tray 23*b*.

Further, in the description on the following embodiments, an "upstream side" and a "downstream side" mean an upstream side and a downstream side in the sheet transport direction D, respectively. Further, in the description on the following embodiments, a "front end" and a "rear end" mean an "end of the downstream side" and an "end of the upstream side" in the sheet transport direction D, respectively. Additionally, in the embodiments, a direction orthogonal to the sheet transport direction D is referred to as a sheet width direction W.

Hereinbelow, the post-processing apparatus 2 will be described with reference to FIG. 3. A transport path 31 is a transport path from a sheet supply port 31*p* and a sheet discharge port 31*d*. The sheet supply port 31*p* is disposed near to the image-forming apparatus 1. The sheets S are supplied from the image-forming apparatus 1 to the sheet supply port 31*p*. Meanwhile, the sheet discharge port 31*d* is located near the standby device 21. The sheets S discharged from the image-forming apparatus 1 are discharged via the sheet discharge port 31*d* to the standby device 21.

The inlet rollers 32*a* and 32*b* are provided near the sheet supply port 31*p*. The inlet rollers 32*a* and 32*b* transport the sheets S, which have been supplied to the sheet supply port 31*p*, toward the downstream side of the transport path 31. For example, the inlet rollers 32*a* and 32*b* transport the sheets S, which have been supplied to the sheet supply port 31*p*, to the transport rollers 33*a* and 33*b*.

The transport rollers 33*a* and 33*b* are disposed near the sheet discharge port 31*d*. The transport rollers 33*a* and 33*b* receive the sheets S transported from the inlet rollers 32*a* and 32*b*. The transport rollers 33*a* and 33*b* transport the sheets S from the sheet discharge port 31*d* to the standby device 21.

The standby device 21 includes a standby tray (buffer tray) 211, a transport guide 212, discharge rollers 213*a* and 213*b*, and an opening and closing drive device (not shown).

The rear end of the standby tray 211 is located near the transport rollers 33*a* and 33*b*. The rear end of the standby tray 211 is located to be slightly lower than the sheet discharge port 31*d* of the transport path 31. The standby tray 211 is tilted with respect to a horizontal direction so as to gradually increase in height toward the downstream side of the sheet transport direction D. During post-processing performed in the processing device 22, the standby tray 211 keeps a plurality of sheets S to be standby in a stacked manner.

Figure 4:
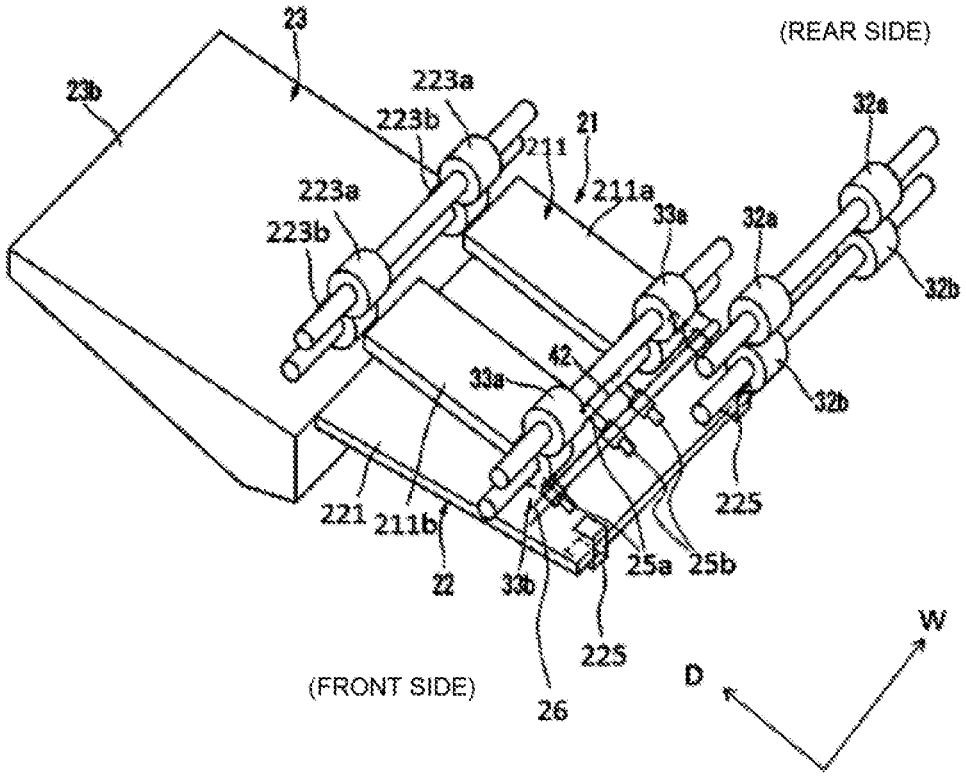
FIG. 4 is a perspective view showing a relationship between standby trays and paddle members of the sheet post-processing apparatus according to the first embodiment.

FIG. 4 is a view schematically showing a relationship between the standby tray 211 and the paddle members 25 described below. The standby tray 211 includes a first tray member 211*a* and a second tray member 211*b*. The first tray member 211*a* and the second tray member 211*b* are separated from each other in the sheet width direction W. The first tray member 211*a* and the second tray member 211*b* are driven by the opening and closing drive device, and move in approaching directions and separating directions.

The first tray member 211*a* and the second tray member 211*b*, which come close to each other, hold the sheets S transported from the transport rollers 33*a* and 33*b*. Meanwhile, the first tray member 211*a* and the second tray member 211*b* move in the separating directions in the sheet width direction W so as to move the sheets S from the standby tray 211 toward the processing tray 221. As a result, the sheets S held by the standby tray 211 drop from a space between the first tray member 211*a* and the second tray member 211*b* down to the processing tray 221.

An assist arm 41 shown in FIG. 3 is provided above the standby tray 211. For example, the assist arm 41 has a length substantially equal to or larger than the half length of the standby tray 211 in the sheet transport direction D. In this embodiment, the assist arm 41 has a length substantially the same as the standby tray 211 in the sheet transport direction D. The assist arm 41 is a plate-like member provided above the standby tray 211. The sheets S discharged from the transport rollers 33*a* and 33*b* enter a space between the assist arm 41 and the standby tray 211.

The processing device 22 shown in FIG. 3 includes the processing tray 221, a stapler 222, support rollers 223*a* and 223*b*, a transport belt 224, a stopper 225, and a lateral alignment member 51.

The processing tray 221 is provided below the standby tray 211. The processing tray 221 is tilted with respect to a horizontal direction so as to gradually increase in height toward the downstream side of the sheet transport direction D. The processing tray 221 is tilted substantially parallel to the standby tray 211. The ends of the plurality of misaligned sheets S moved to the processing tray 221 are aligned in the sheet width direction W by the lateral alignment member 51. Hereinafter, aligning the ends of the misaligned sheets in the sheet width direction W may simply refer to lateral alignment processing.

The stapler 222 is provided to the rear end of the processing tray 221. The stapler 222 performs stapling (binding) processing on a bundle of the plurality of sheets S on the processing tray 221.

The support rollers 223*a* and 223*b* are disposed with a predetermined distance therebetween in the sheet transport direction D. The transport belt 224 is stretched over the transport rollers 223*a* and 223*b*. The transport belt 224 rotates in synchronization with the rotating transport rollers 223*a* and 223*b*. The transport belt 224 transports the sheets S between the stapler 222 and the discharge device 23.

The stopper 225 is disposed upstream of the sheet transport direction viewed from the transport rollers 223*b*. The sheets S move from the standby tray 211 to the processing tray 221, and come in contact with stopper 225. Therefore the stopper 225 aligns the sheets S misaligned in the sheet transport direction. In other words, the sheets S come in contact with the stopper 225 as a reference when the ends of the sheets S misaligned in the sheet transport direction are to be aligned. Specifically, the sheets S are moved by the first paddle 25*a* and the second paddle 25*b* described below toward upstream in the sheet transport direction, and come in contact with the stopper 225. Thus, the ends of the sheets misaligned in the sheet transport direction are aligned. Hereinafter, aligning the ends of the sheets misaligned in the sheet transport direction (aligning the ends of the sheets in the direction orthogonal to the sheet width direction W) will be simply referred to as longitudinal alignment processing.

Figure 16:
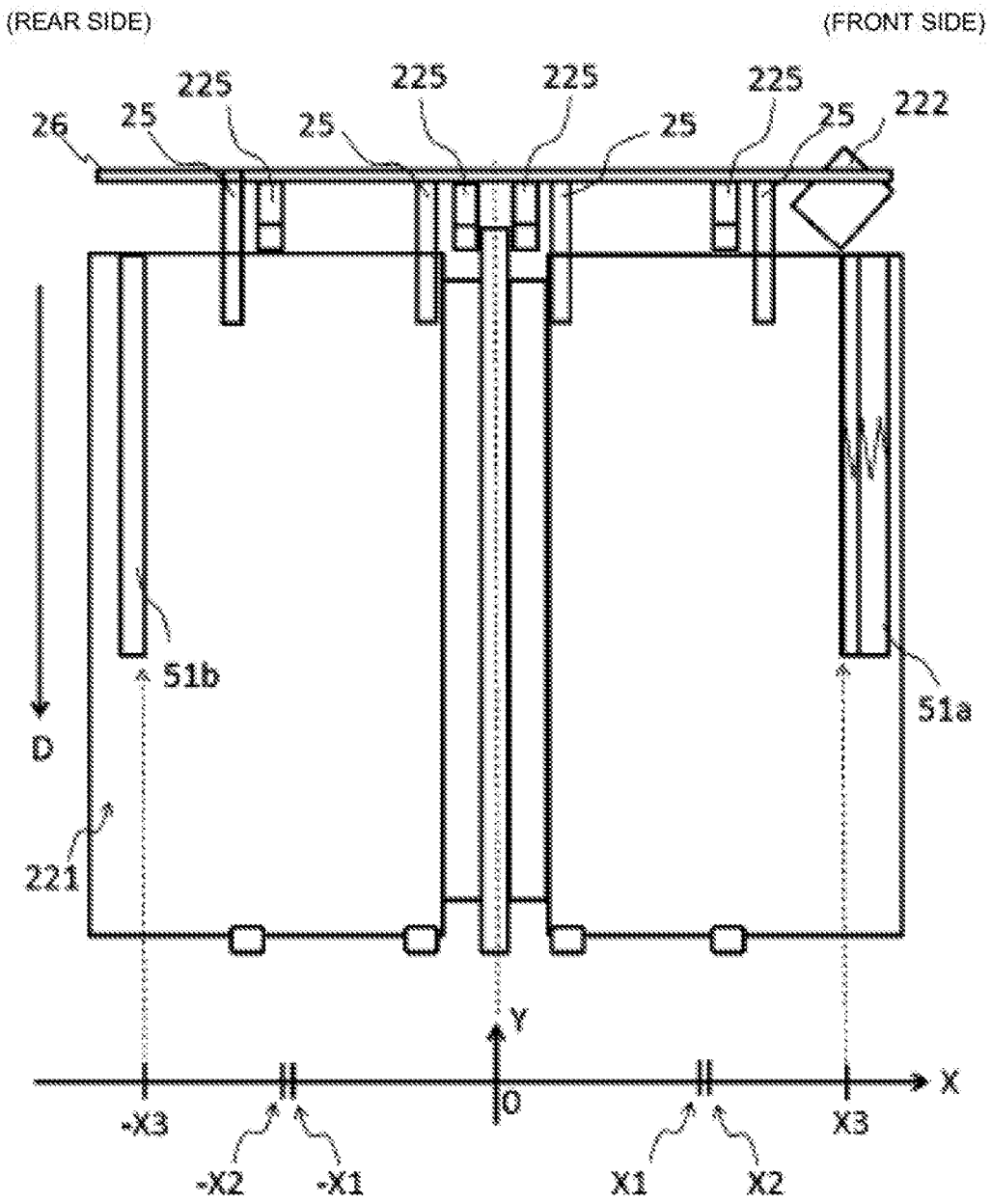
FIG. 16 is a view showing each operation position on the processing tray of a first alignment plate and a second alignment plate of a sheet post-processing apparatus according to a second embodiment.

The lateral alignment member 51 includes the first alignment plate 51*a* and the second alignment plate 51*b* (for example, see FIG. 16). The first alignment plate 51*a* is an alignment plate located at a front side (near side) of the sheet post-processing apparatus 2, and the second alignment plate 51*b* is an alignment plate located at a rear side (far side) of the post-processing apparatus 2. The first alignment plate 51*a* and the second alignment plate 51*b* are movable to the W direction orthogonal to the sheet transport direction. The first alignment plate 51*a* and the second alignment plate 51*b* are movable in synchronization or independently by the first lateral alignment motor 29*a* and the second lateral alignment motor 29*b* in the sheet width direction W. As a result, the position of the sheets S is changed. The first alignment plate 51*a* and the second alignment plate 51*b* are also used to sort the sheets S. The first alignment plate 51*a* and the second alignment plate 51*b* are disposed having a predetermined space (distance) at the standby position. The sheets S moved from the standby tray 211 are stacked in the space between the first alignment plate 51*a* and the second alignment plate 51*b*. The first alignment plate 51*a* and the second alignment plate 51*b* facing each other come in contact with the sheets S, and thereby the sheets S are aligned in the direction orthogonal to the sheet transport direction. It should be noted that a damper is formed on the first alignment plate 51*a*.

The paddle member 25 shown in FIG. 3 includes a first paddle 25*a*, a second paddle 25*b*, a rotating shaft 26, and a rotating body 27.

The rotating shaft 26 is the center of rotation of the first paddle 25*a* and the second paddle 25*b* as described later. The rotating shaft 26 is positioned lower than the standby tray 211. The rotating shaft 26 extends in the sheet width direction W. The rotating shaft 26 is driven by the paddle motor 28, and rotates in the arrow-A direction (counterclockwise direction) in FIG. 3. Further, a plurality of paddle members 25 are disposed in the sheet width direction W (see FIG. 4).

Specifically, as shown in FIG. 4, the plurality of paddle members 25 are disposed at the rotating shaft 26 extending in the sheet width direction W. The paddle members 25 are disposed on the rotating shaft 26 symmetrically about the center of the processing tray 221 having a predetermined distance between the paddle members 25. Further, the first paddle 25*a* and the second paddle 25*b* rotate, and come in contact with the sheets S on the processing tray 221. The paddle members 25 are attached to the rotating shaft 26, and thus rotate in synchronization with the rotation of the rotating shaft 26.

Figure 5:
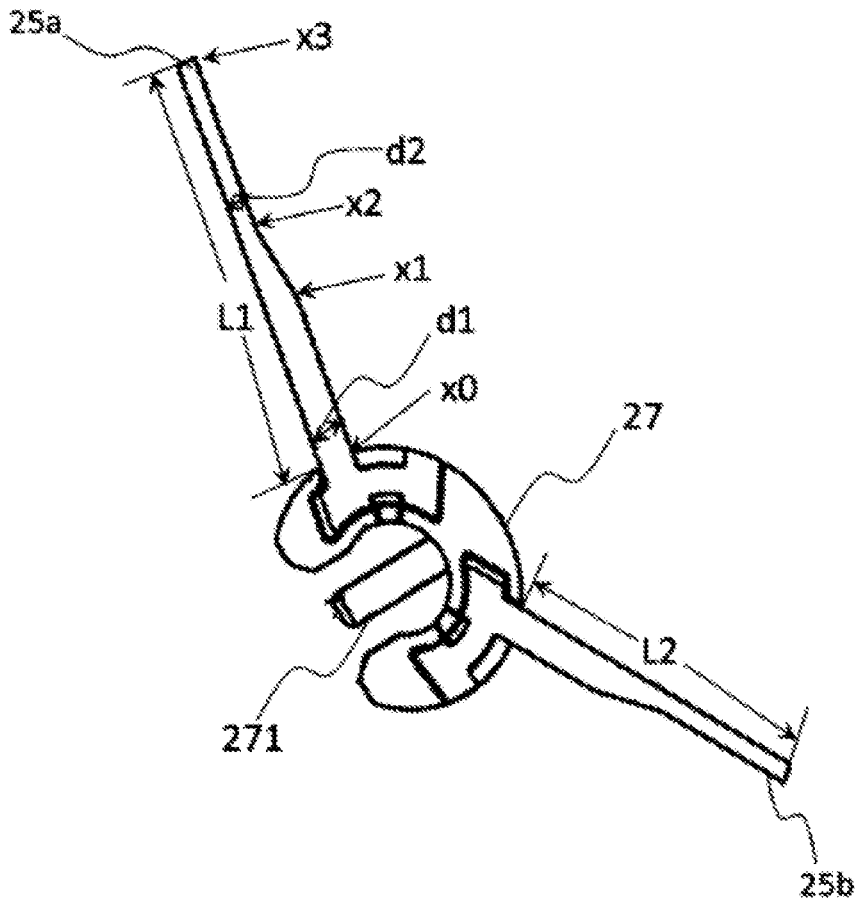
FIG. 5 is a view showing a detailed structure of the paddle member of the sheet post-processing apparatus according to the first embodiment.

FIG. 5 is a view showing a detailed structure of the paddle member 25. As described above, the paddle member 25 includes the first paddle 25*a*, the second paddle 25*b*, and the rotating body 27.

The rotating body 27 has a cylindrical shape, a part of which is absent. The rotating body 27 has a protrusion 271. The protrusion 271 is engaged with a preformed groove of the rotating shaft 26 such that the rotating body 27 is detachably mounted to the rotating shaft 26. Once the rotating shaft 26 rotates in the arrow-A direction (counterclockwise) in FIG. 3, the rotating body 27 rotates in the same direction. Further, the first paddle 25*a* and the second paddle 25*b* are attached to the rotating body 27, and thus rotate counterclockwise together with the rotating body 27, when the rotating shaft 26 rotates in the arrow-A direction in FIG. 3.

The first paddle 25*a* and the second paddle 25*b* are formed of an elastic material such as rubber and resin. The first paddle 25*a* protrudes from the rotating body 27 in a radial direction of the rotating body 27, and is attached to the rotating body 27. The first paddle 25*a* has a length L1 in the radial direction of the rotating body 27. The first paddle 25*a* has a shape that the thickness d1 of the portion attached on the rotating body 27 is different from the thickness d2 of the portion at the end of the paddle. In detail, the portion of the first paddle 25*a* between the position x0 and the position x1 has the thickness d1, the first paddle 25*a* being attached on the rotating body 27 at the position x0, the first paddle 25*a* protruding from the position x0 to the position x1 in the radial direction. Further, the thickness of the portion of the first paddle 25*a* between the position x1 and the position x2 gradually decreases from the position x1 to the position x2, the position x1 having the thickness d1. The first paddle 25*a* has the thickness d2 (<d1) in the portion between the position x2 and the position x3.

The second paddle 25*b* is attached to the rotating body 27, the second paddle 25*b* and the first paddle 25*a* forming a predetermined angle therebetween. In other words, the second paddle 25*b* is formed on the rotating body 27 behind the first paddle 25*a* by a predetermined distance in the arrow-A direction in FIG. 3.

The second paddle 25*b* is attached to the rotating body 27, and protrudes from the rotating body 27 in the radial direction of the rotating body 27. The length L2 of the second paddle 25*b* in the radial direction of the rotating body 27 is smaller than the length L1 of the first paddle 25*a* in the radial direction of the rotating body 27. Similar to the first paddle 25*a*, the second paddle 25*b* has a shape that the thickness d1 of the portion attached on the rotating body 27 is larger than the thickness d2 at the end of the paddle. The shape of the second paddle 25*b* is similar to that of the first paddle 25*a*, and description thereof is therefore omitted.

With reference to FIG. 6 to FIG. 14, operations of the first paddle 25*a* and the second paddle 25*b* will be described.

Figure 6:
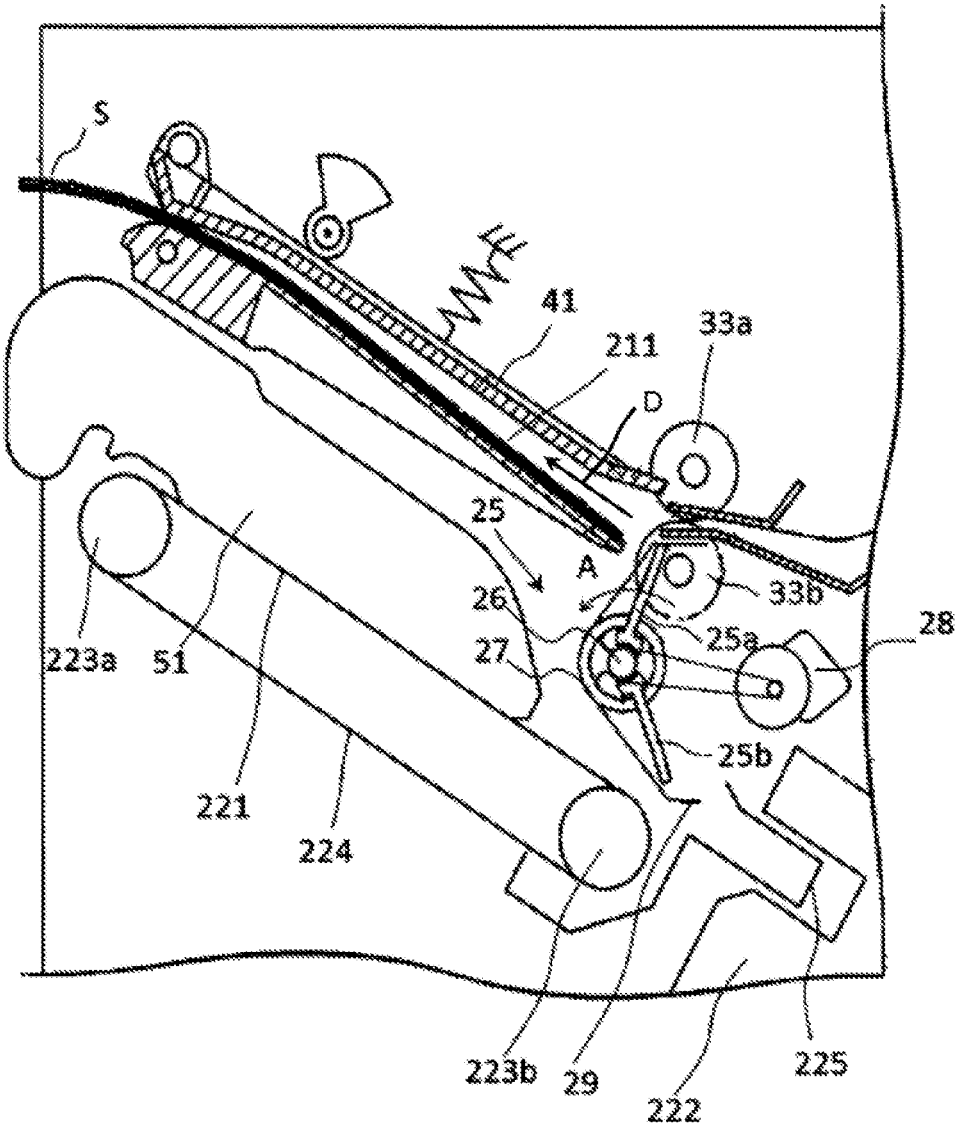
FIG. 6 is a cross-sectional view showing a standby position of a first paddle and a second paddle of the sheet post-processing apparatus according to the first embodiment.

FIG. 6 is a view showing a standby position before the first paddle and the second paddle 25*b* are rotated. The standby position is a position where the first paddle 25*a* and the second paddle 25*b* stand by when the sheets S transported from the transport rollers 33*a* and 33*b* are retained on the standby tray 211, or when the sheets S are transported from the transport rollers 33*a* and 33*b* directly to the processing tray 221. In other words, the standby position is a position where the longitudinal alignment processing is not performed on the sheets S by using the first paddle 25*a* and the second paddle 25*b*.

In the standby position in FIG. 6, the first paddle 25*a* is located at a position where the first paddle 25*a* is not protruded from an outer circumferential surface of the transport roller 33*b* to the downstream side in the sheet transport direction D viewed from the axis of the transport roller 33*b*. From a different point of view, the first paddle 25*a* is located at the upstream side, in the transport direction, of the outer circumferential surface of the transport roller 33*b* located near the standby tray 211 viewed from the standby tray 211, where the transport of the sheets S transported from the transport roller 33*b* to the standby tray 211 is not hindered. Further, the end of the second paddle 25*b* is located at a position where the end of the second paddle 25*b* is apart from the sheets S on the processing tray 221 by a predetermined distance.

Figure 7:
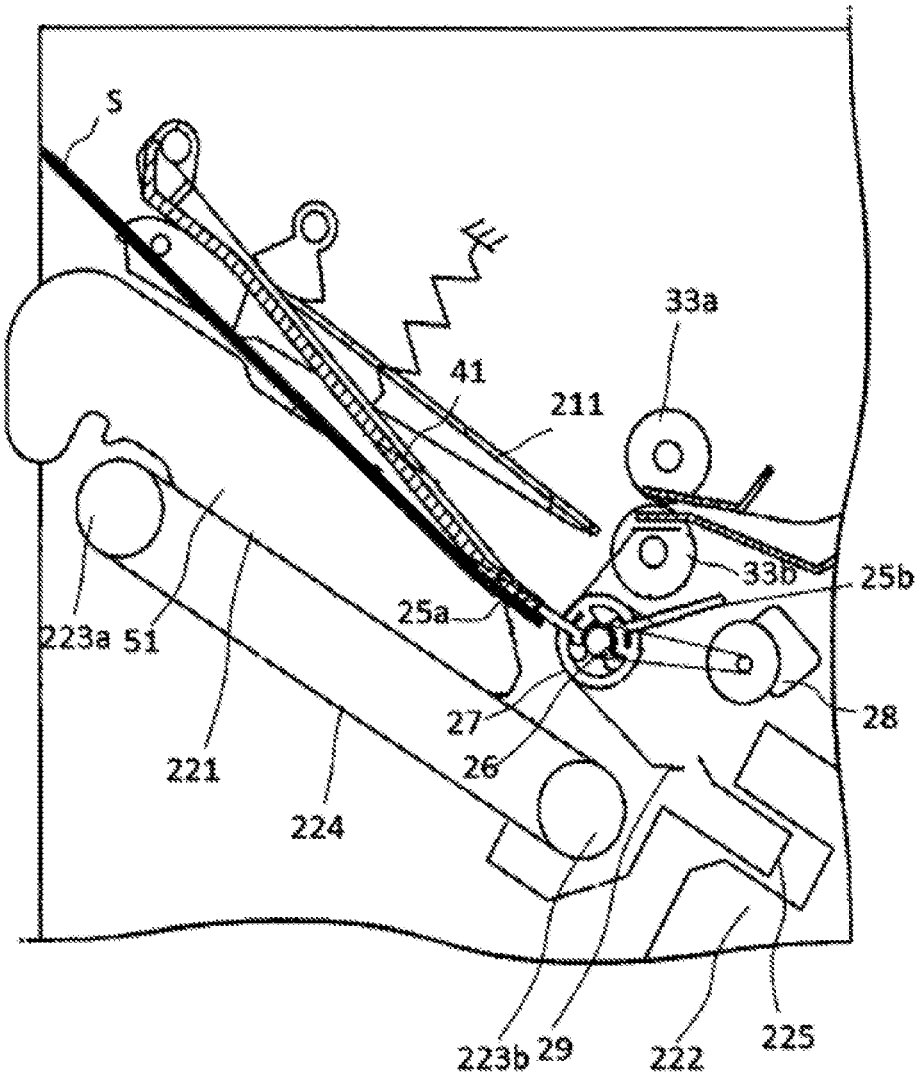
FIG. 7 is a cross-sectional view showing movement of a sheet from the standby tray to a processing tray by using the first paddle of the sheet post-processing apparatus according to the first embodiment.

FIG. 7 is a view showing a state where the first paddle 25*a* is in contact with the sheets S transported from the standby tray 211 to the processing tray 221. In the case where the predetermined number of the sheets S is retained on the standby tray 211, the post-processing controller 24 drives the pair of standby tray members 211*a* and 211*b* (see FIG. 4) to separate from each other in both the sheet width directions W, and moves the retained sheets S to the processing tray 221.

The post-processing controller 24 drives the paddle motor 28 to thereby rotate the rotating shaft 26. The first paddle 25*a* rotates together with the rotation of the rotating shaft 26, thereby comes in contact with the sheets S dropped from the standby tray 211, and applies a force on the sheets S to move toward the processing tray 221. The operation that the first paddle 25*a* comes in contact with the sheets S to allow the sheets S to move from the standby tray 211 to the processing tray 221 will sometimes be referred to as "a first operation".

Figure 8:
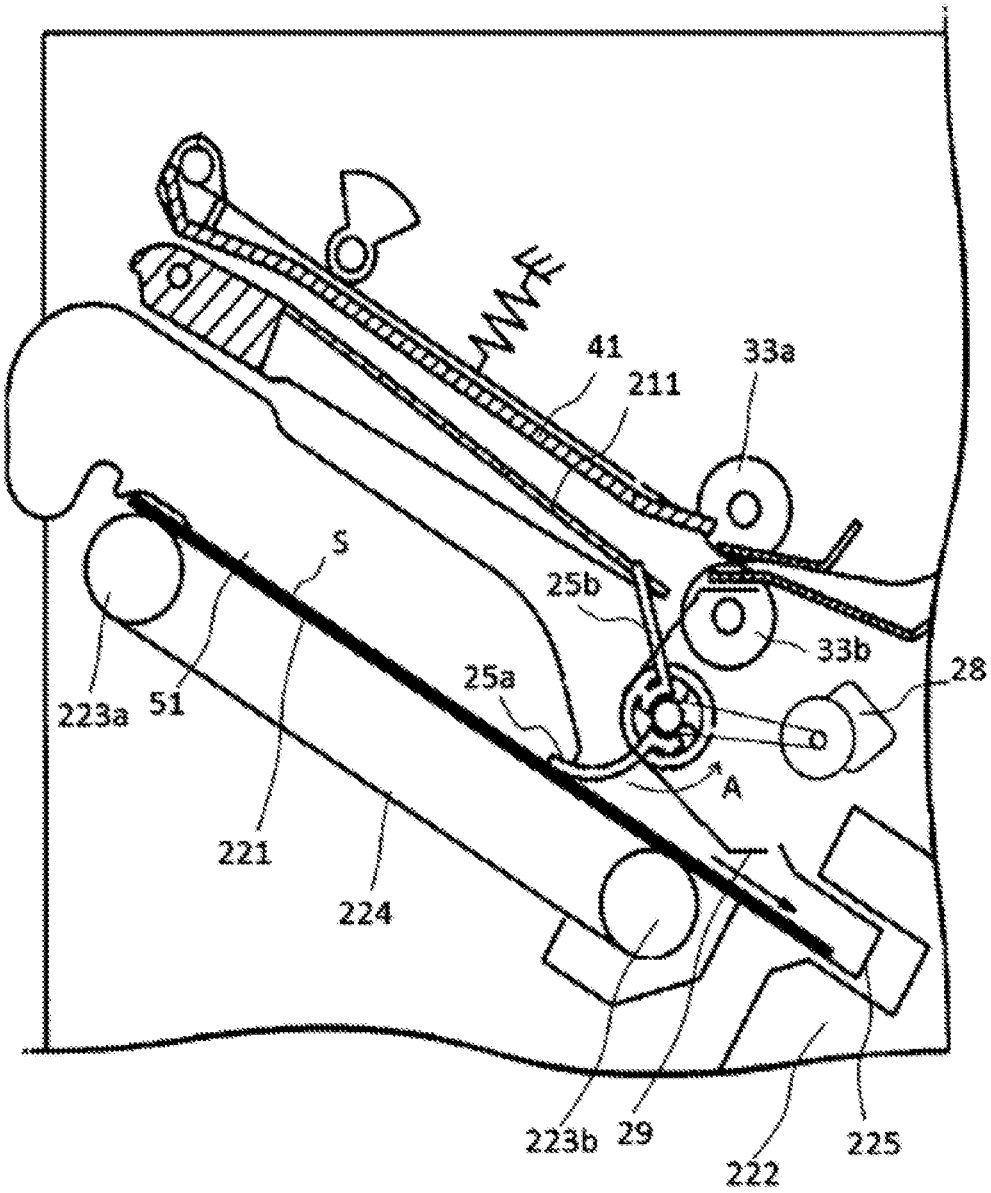
FIG. 8 is a cross-sectional view showing the longitudinal alignment processing performed by using the first paddle of the sheet post-processing apparatus according to the first embodiment.

FIG. 8 is a view showing that the first paddle 25*a* further rotates in the arrow-A direction (counterclockwise), and the longitudinal alignment processing is executed on the sheets S moved to the processing tray 221.

The first paddle 25*a* in the state in FIG. 7 further rotates in the arrow-A direction, guides the sheets S to the processing tray 221, holds the sheets S with the processing tray 221 therebetween, and is bent (see FIG. 8). The first paddle 25*a*, which is still bent, rotates in the arrow-A direction, and thereby moves the sheets S toward the stopper 225 located upstream of the processing tray 221 in the sheet transport direction. Specifically, the first paddle 25*a* holds the bundle of the plurality of sheets S with the processing tray 221 therebetween, and presses the bundle against the stopper 225 such that the longitudinal alignment processing is performed. The operation that the first paddle 25*a* performs the longitudinal alignment processing on the sheets S may be called to as "a second operation".

Figure 9:
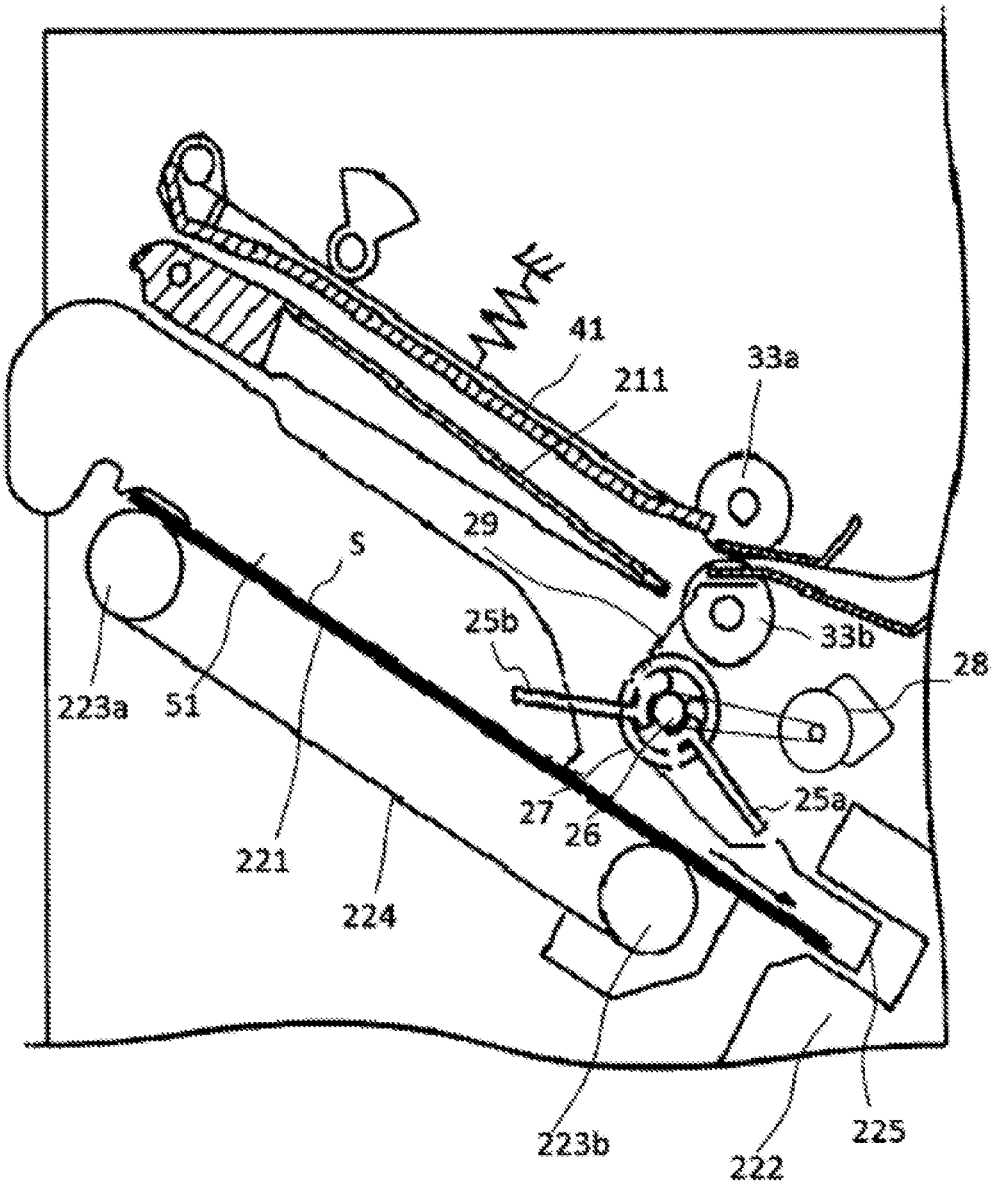
FIG. 9 is a cross-sectional view showing a stop position of the first paddle and the second paddle of the sheet post-processing apparatus according to the first embodiment.

FIG. 9 is a view showing the state of the first paddle 25*a* and the second paddle 25*b* after the longitudinal alignment processing is performed on the sheets S by using the first paddle 25*a* shown in FIG. 8.

After the longitudinal alignment processing is performed on the sheets S by using the first paddle 25*a*, and the first paddle 25*a* leaves from the sheets S on the processing tray 221, the post-processing controller 24 controls the paddle motor 28 to stop rotation of the rotating shaft 26. Thus, the rotation of the first paddle 25*a* and the second paddle 25*b* stops. The second paddle 25*b* stops at the position apart from the sheets S on the processing tray 221 by a predetermined distance. Specifically, after the longitudinal alignment processing is performed on the sheets S by using the first paddle 25*a*, the first paddle 25*a* and the second paddle 25*b* stop a rotation operation at the position apart from the sheets S on the processing tray 221 for a predetermined distance. The position of the paddle member 25 shown in FIG. 9 is referred to as "a first stop position".

Here, a reason why the first paddle 25*a* and the second paddle 25*b* stop at the first stop position is as follows. After the longitudinal alignment processing is executed on the sheets S by using the first paddle 25*a*, processing to align the ends of the sheets S in the sheet width direction W by the lateral alignment member 51 (lateral alignment processing) is executed. If the first paddle 25*a* or the second paddle 25*b* is in contact with the sheets S during the lateral alignment processing, the lateral alignment processing is hindered. Therefore, the first paddle 25*a* and the second paddle 25*b* are apart from the sheets S.

Figure 10:
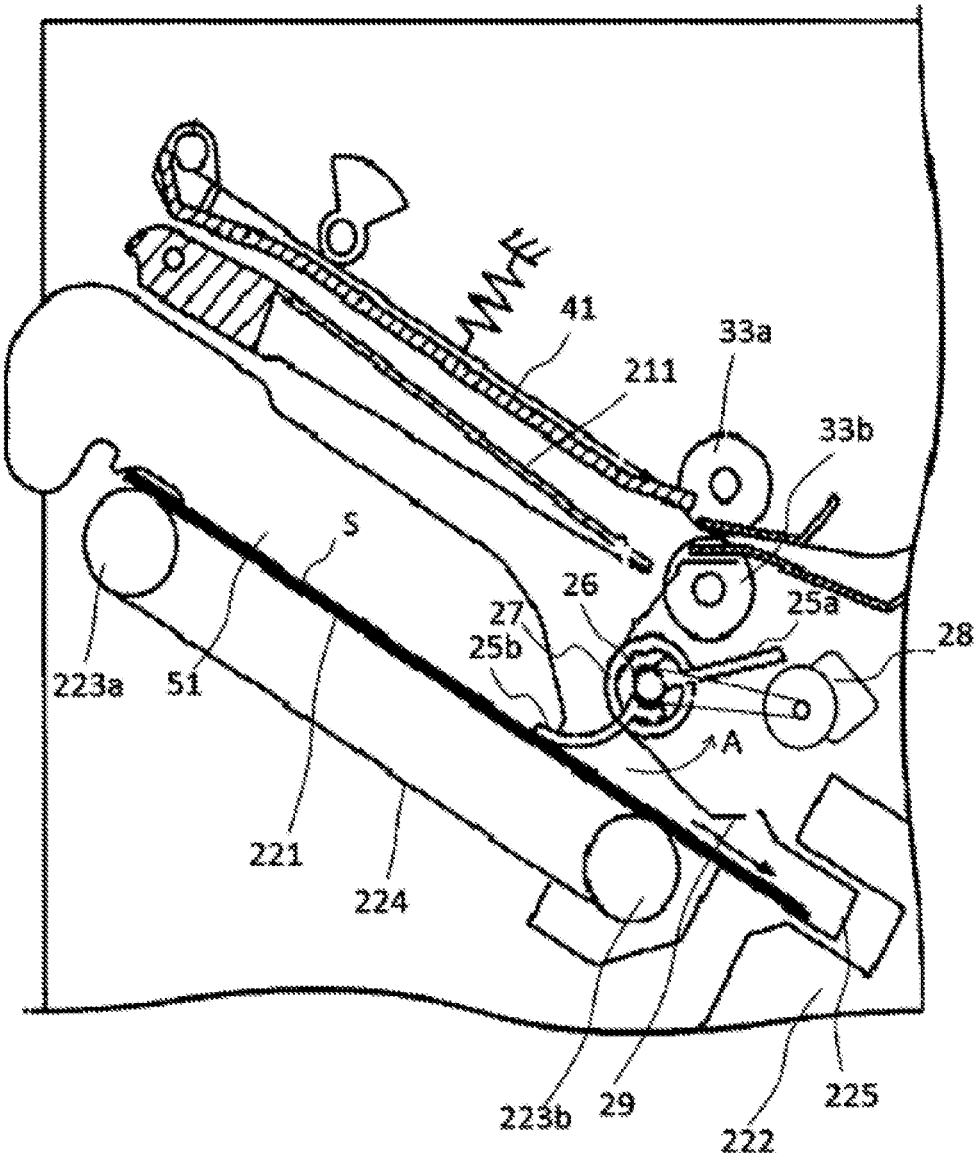
FIG. 10 is a cross-sectional view showing the longitudinal alignment processing performed by using the second paddle of the sheet post-processing apparatus according to the first embodiment.

FIG. 10 is a view showing that the second paddle 25*b* performs the longitudinal alignment processing on the sheets S. The post-processing controller 24 drives the paddle motor 28 to thereby rotate again the first paddle 25*a* and the second paddle 25*b* in the arrow-A direction. The first paddle 25*a* and the second paddle 25*b* are driven by the paddle motor 28 and rotate counterclockwise.

Hereinafter, the sheet post-processing apparatus 2 will be described where the second paddle 25*b* is focused on.

The second paddle 25*b* comes in contact with the sheets S, is bent, moves the sheets S toward the stopper 225, and presses the sheets S against the stopper 225. The operation that the second paddle 25*b* performs the longitudinal alignment processing on the sheets S may be referred to as "a third operation".

Here, a reason why the longitudinal alignment processing is further performed by using the second paddle 25*b* is as follows. When the sheets S are pressed against the stopper 225 by using the first paddle 25*a*, the sheets S may sometimes be pressed too much. In this case, the sheets S are pressed against the stopper 225, and move in the sheet transport direction D by a repulsive force. Thus, the longitudinal alignment processing on the sheets S may not be executed accurately. In this regard, after the sheets S are pressed by the first paddle 25*a*, the sheets S are pressed again by the second paddle 25*b*. Thus, the longitudinal alignment processing is executed again on the sheets S on which the sufficient longitudinal alignment processing is not performed by using the first paddle 25*a*, and the alignment state may be more accurate in the sheet transport direction.

Figure 11:
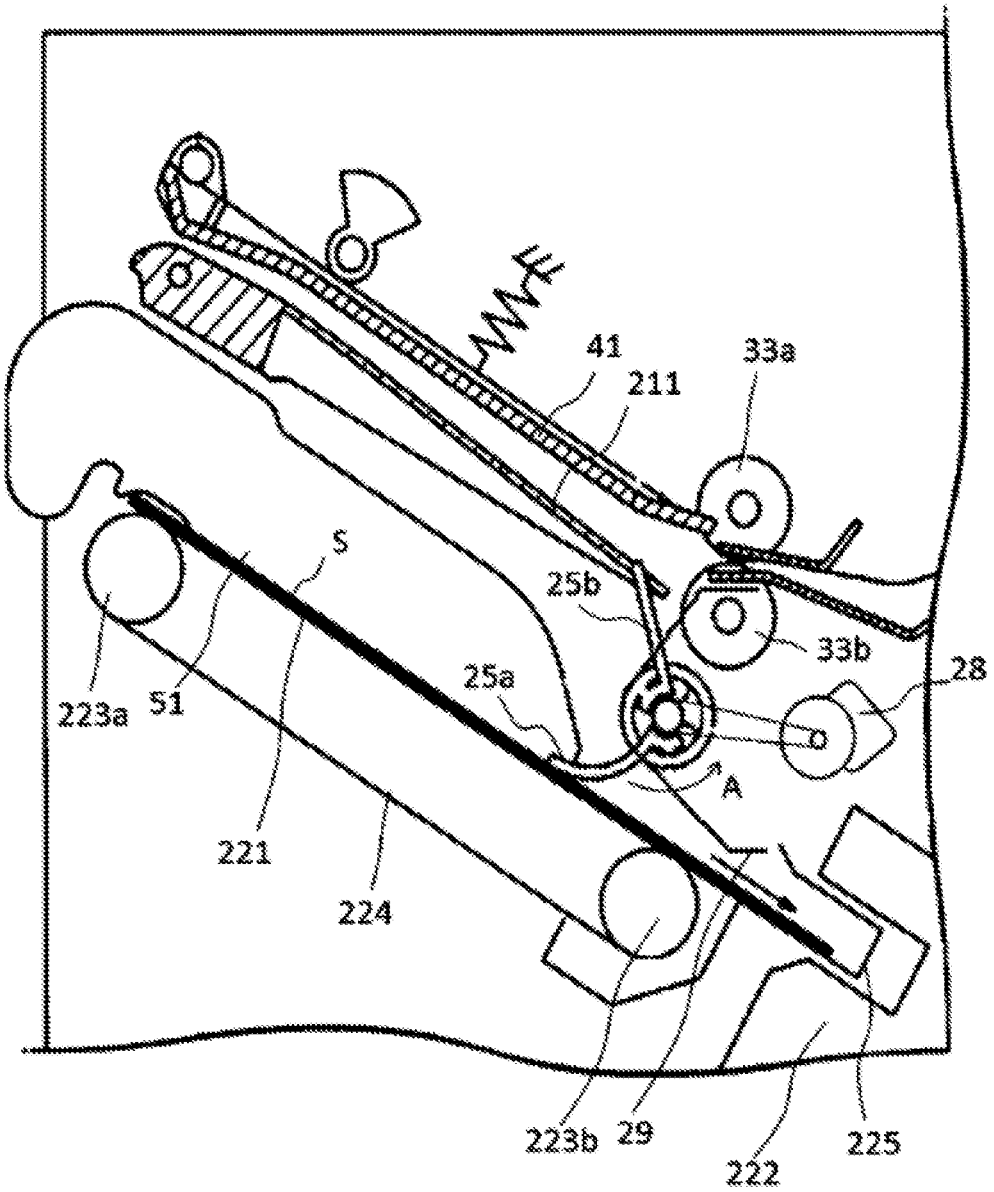
FIG. 11 is a view showing the longitudinal alignment processing performed by using the first paddle for the second time of the sheet post-processing apparatus according to the first embodiment.

FIG. 11 is a view showing that, after the longitudinal alignment processing is performed by using the second paddle 25*b*, the paddle member 25 is further rotated in the A direction, and the longitudinal alignment processing is executed again by using the first paddle 25*a*.

The first paddle 25*a*, which is still bent, rotates in the arrow-A direction, and thereby moves the sheets S to the stopper 225 such that the longitudinal alignment processing is performed. Thereafter, the rotating first paddle 25*a* and second paddle 25*b* stop again at the first stop position (see FIG. 9).

Figure 12:
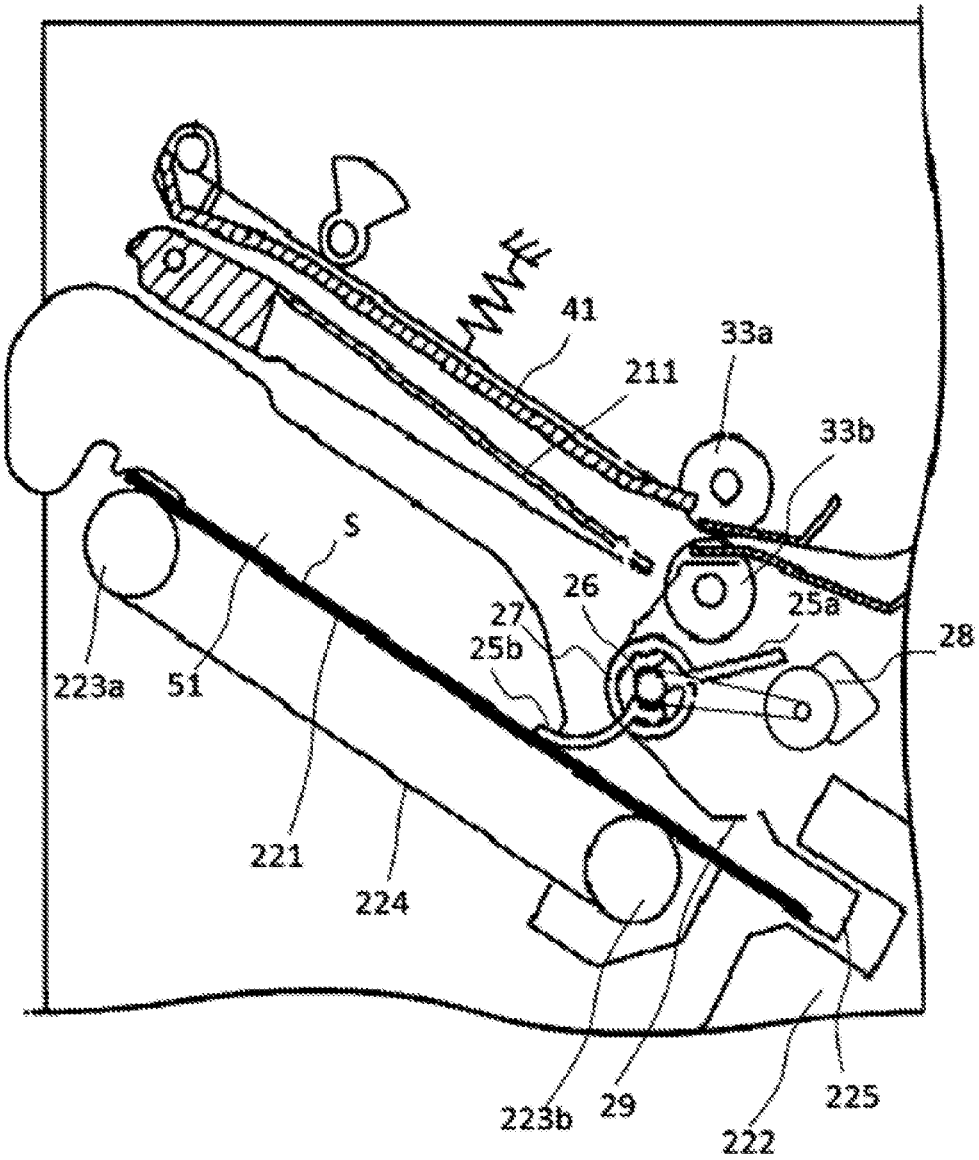
FIG. 12 is a view showing a sheet pressing state performed by the second paddle of the sheet post-processing apparatus according to the first embodiment.

FIG. 12 is a view showing that the second paddle 25*b* presses the bundle of the plurality of sheets S.

Figure 13:
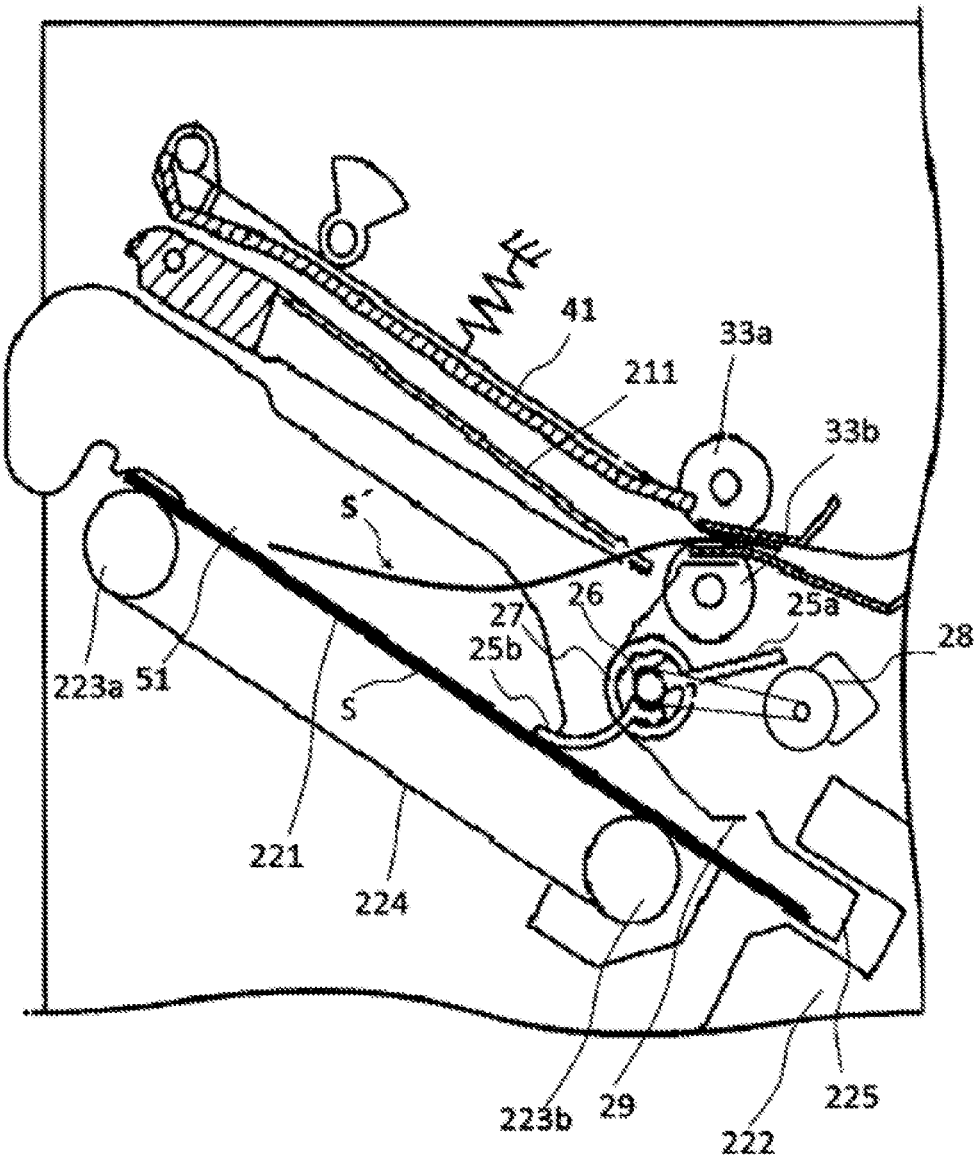
FIG. 13 is a view showing that subsequent sheets are to be received where the second paddle of the sheet post-processing apparatus according to the first embodiment is in contact with the plurality of sheets.

The post-processing controller 24 further rotates the paddle member 25 (the first paddle 25*a* and the second paddle 25*b*) stopped at the first stop position (see FIG. 9) from the first stop position in the arrow-A direction, and stops the paddle member 25 at a second stop position. At the second stop position, the end of the second paddle 25*b* comes in contact with the bundle of the plurality of sheets S on which the longitudinal alignment processing is applied, and is bent. Further, at the second stop position, the first paddle 25*a* is not protruded from the paddle guide 29. FIG. 13 is a view showing that subsequent sheets S' are to be received where the second paddle 25*a* is in contact with the plurality of sheets S (at the second stop position). The first paddle 25*a* is stopped at the second stop position, and it is thus possible to transport the subsequent sheets S' to the processing tray 221 while holding the sheets S pressed by the second paddle 25*b*. The transport rollers 33*a* and 33*b* transport the sheets S' to the processing tray 221.

Figure 14:
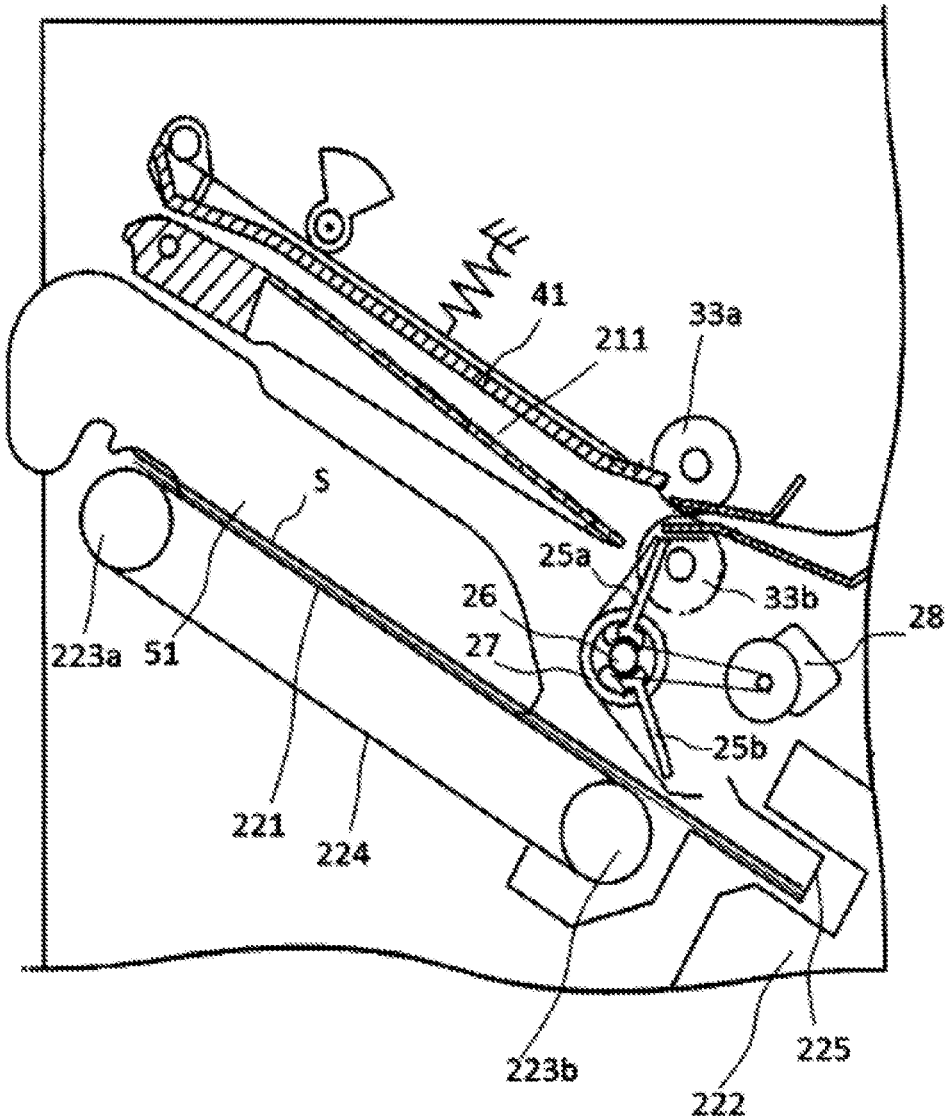
FIG. 14 is a view showing the standby position of the first paddle and the second paddle of the sheet post-processing apparatus according to the first embodiment.

FIG. 14 is a view showing the first paddle 25*a* and the second paddle 25*b* return to the standby position. The first paddle 25*a* and the second paddle 25*b* of the state shown in FIG. 13 (at the second stop position) further rotate in the arrow-A direction to the standby position. As a result, a series of operations is completed.

Figure 15:
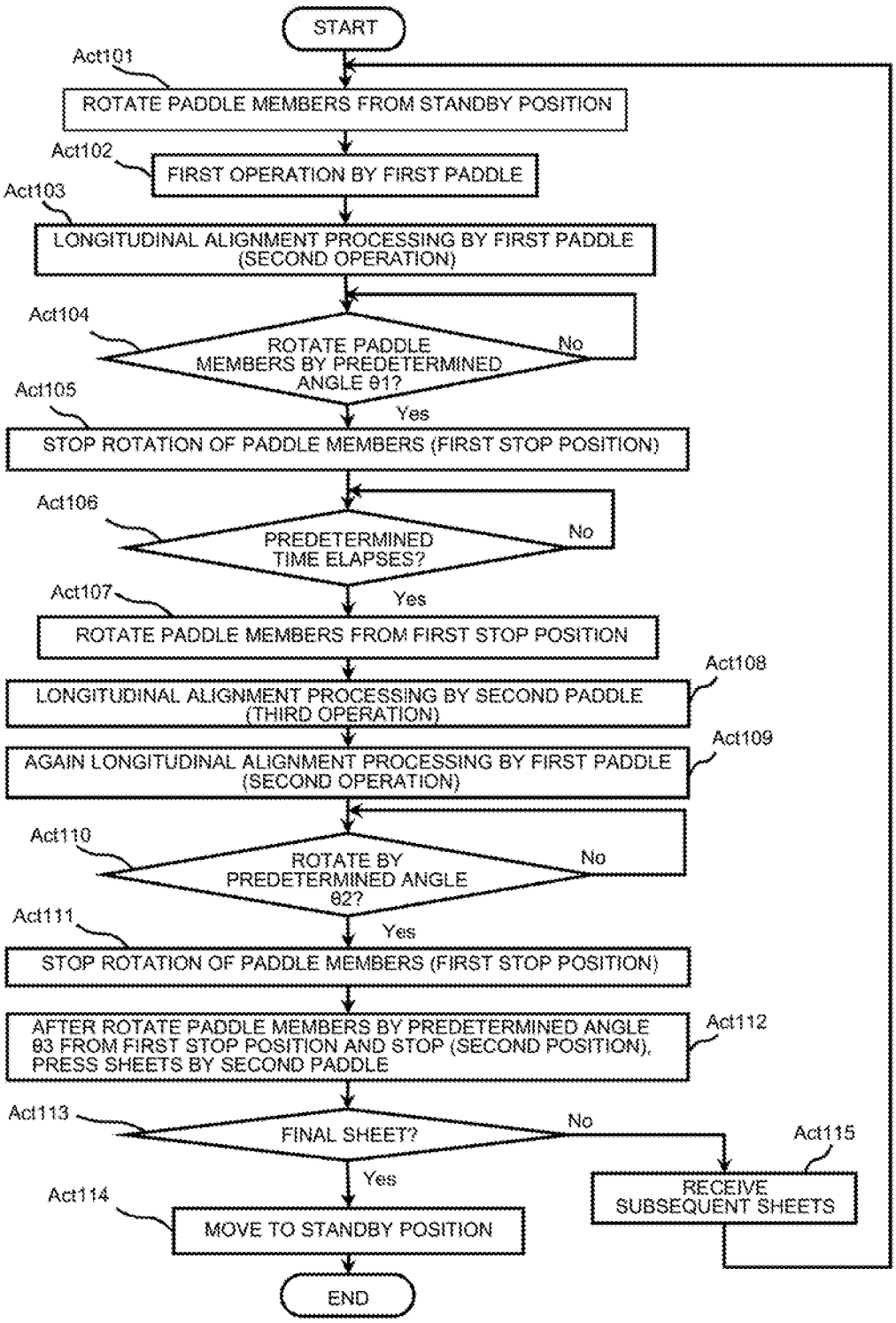
FIG. 15 is a flowchart showing a control executed by a post-processing controller of the sheet post-processing apparatus according to the first embodiment.

FIG. 15 is a flowchart showing a control of the rotation operation of the paddle members 25 (the first paddle 25*a* and the second paddle 25*b* ) shown in FIG. 6 to FIG. 14 executed by the post-processing controller 24. Note that when operations and processing common to the first paddle 25*a* and the second paddle 25*b* are described below, the first paddle 25*a* and the second paddle 25*b* are simply referred to as the paddle member 25 (or paddle members 25) for convenience. In other words, when the term paddle member 25 is used, the paddle member 25 means both of the first paddle 25*a* and the second paddle 25*b*.

The post-processing controller 24 drives the paddle motor 28 in a positive direction to rotate the first paddle 25*a* and the second paddle 25*b* in the arrow-A direction (counterclockwise direction) about the rotating shaft 26. Further, the post-processing controller 24 drives the paddle motor 28 in the direction opposite to the positive direction to rotate the first paddle 25*a* and the second paddle 25*b* clockwise around the rotating shaft 26.

First, when the plurality of sheets S are retained on the standby tray 211, the post-processing controller 24 drives the paddle motor 28 in the positive direction to rotate the paddle members 25 from the standby position shown in FIG. 6 to the arrow-A direction in Act101 in FIG. 15.

In Act102, the post-processing controller 24 causes the paddle members 25 to come in contact with the sheets S. The first paddle 25*a* comes in contact with the sheets moving from the standby tray 211 to the processing tray 221, and assists the sheets S to move faster to processing tray 221 (see FIG. 7).

In Act103, the post-processing controller 24 keeps on rotating the paddle members 25, and allows the first paddle 25*a* to execute the longitudinal alignment processing. The first paddle 25*a* executes the longitudinal alignment processing on the sheets S moved to the processing tray 221 (see FIG. 8). In other words, the first paddle 25*a* comes in contact with the sheets S on the processing tray 221, moves the sheets S to the stopper 225, and presses the sheets S against the stopper 225. Therefore the first paddle 25*a* accurately aligns the ends of the sheets S in the sheet transport direction D. Thus, the first paddle 25*a* executes the longitudinal alignment processing.

In Act104, the post-processing controller 24 determines whether or not the paddle members 25 rotate by a predetermined angle θ1 from the standby position (see FIG. 6). When the post-processing controller 24 determines that the paddle members 25 rotate by the predetermined angle θ1 (Yes in Act104), the processing of the post-processing controller 24 proceeds to Act105. In Act105, the post-processing controller 24 stops the rotation of the paddle members 25. As a result, the paddle members 25 stop at the first stop position (see FIG. 9). When the post-processing controller 24 determines that the paddle members 25 are yet to rotate by the predetermined angle θ1 (No in Act104), the post-processing controller 24 keeps on rotating the paddle members 25.

In Act106, the post-processing controller 24 determines whether or not a predetermined time elapses after the rotation of the paddle members 25 is stopped in Act105.

When the post-processing controller 24 determines that the predetermined time is yet to elapse (No in Act106), the post-processing controller 24 stands by until the predetermined time elapses. When the post-processing controller 24 determines that the predetermined time elapses (Yes in Act106), the processing of the post-processing controller 24 proceeds to Act107. In Act107, the post-processing controller 24 rotates again the paddle members 25. The paddle members 25 are driven by the paddle motor 28, and rotate from the first stop position (see FIG. 9) in the arrow-A direction (counterclockwise).

In Act108, the post-processing controller 24 keeps on rotating the paddle members 25, and allows the second paddle 25*b* to execute the longitudinal alignment processing, as shown in FIG. 10.

Further, in Act109, the post-processing controller 24 keeps on rotating the paddle members 25, and allows the first paddle 25*a* to execute again the longitudinal alignment processing, as shown in FIG. 11.

In Act110, the post-processing controller 24 determines whether or not the paddle members 25 rotate by a predetermined angle θ2 from the standby position (see FIG. 6). When the post-processing controller 24 determines that the paddle members 25 rotate by the predetermined angle θ2 (Yes in Act110), the processing of the post-processing controller 24 proceeds to Act111. In Act111, the post-processing controller 24 stops again the rotation of the paddle members 25. As a result, the paddle members 25 stop again at the first stop position (see FIG. 9).

Next, in Act112, the post-processing controller 24 rotates the paddle members 25 by a predetermined angle θ3 from the first stop position (see FIG. 9), and stops the rotation of the paddle members 25. The second paddle 25*b* rotates by the predetermined angle θ3, and then stops at the second stop position, where the second paddle 25*b* comes in contact with the sheets S on the processing tray 221 (see FIG. 12). The second paddle 25*b* is formed of an elastic material such as rubber and resin, and thus presses the sheets on the processing tray 221 at the second stop position in the bent state. As a result, the aligned sheets, on which the longitudinal alignment processing and the lateral alignment processing are applied, are not to be misaligned. In the second stop position, the first paddle 25*a* is located at the position that does not inhibit the subsequent sheets S' from transporting to the processing tray 221 (for example, see FIG. 13). Absolute values of the angles θ1, θ2, and θ3 have a relationship represented by $\theta 3<\theta 1<\theta 2$.

In Act113, the post-processing controller 24 determines whether or not the sheet processed in Act112 is the final sheet. When the post-processing controller 24 determines that the sheet processed in Act112 is not the final sheet (No in Act113), the processing of the post-processing controller 24 proceeds to Act115. In Act115, the post-processing controller 24 stands by for receiving the subsequent sheets S' on the processing tray 221. Here, when the subsequent sheets S' are transported to the processing tray 221, the front ends of the subsequent sheets S' may come in contact with the sheets S on the processing tray 221 and the sheets S, on which the alignment processing is already applied, may be misaligned.

However, in this embodiment, the second paddle 25*b* presses the sheets S after the alignment processing. As a result, even if the front ends of the subsequent sheets S' come in contact with the processing tray 221, the aligned sheets S may not to be misaligned.

It should be noted that the post-processing controller 24 controls the transport rollers 33*a* and 33*b* in Act115, and transports the subsequent sheets S' to the processing tray 221. After the subsequent sheets S' are transported to the processing tray 221, the processing of the post-processing controller 24 returns to Act101. In Act101, the post-processing controller 24 rotates again the paddle members 25 in the arrow-A direction (counterclockwise), and guides the subsequent sheets S' to the processing tray 221. Then, the post-processing controller 24 executes the processing in Act102 to Act113 as described above.

Meanwhile, when the post-processing controller 24 determines that the sheet processed in Act112 is the final sheet (Yes in Act113), the processing of the post-processing controller 24 proceeds to Act114. In Act114, the post-processing controller 24 moves the paddle members 25 to the standby position. A series of processing is completed.

According to this embodiment, the sheets S on which the alignment processing is already executed are pressed by the second paddle 25*b*, and it is therefore possible to prevent the sheets S on the processing tray from being misaligned.

Next, a second embodiment will be described with reference to FIG. 16 and FIG. 17. In the second embodiment, stapling processing is performed by the stapler 222 where the plurality of sheets S on the processing tray 221 are pressed by the paddle members 25.

FIG. 16 is a view showing a relationship among the paddle members 25, the first alignment plate 51*a*, and the second alignment plate 51*b* on the processing tray 221.

The lateral alignment member 51 (including the first alignment plate 51*a* and the second alignment plate 51*b* ) is moved to the standby position, a first alignment position, and a second alignment position on the processing tray 221.

The standby position is the position of the first alignment plate 51*a* and the second alignment plate 51*b* that receive the sheets S discharged from the transport rollers 33*a* and 33*b*, or the sheets S moved from the standby tray 211. It should be noted that the position of the first alignment plate 51*a* and the second alignment plate 51*b* in FIG. 16 shows the standby position.

The first alignment position is the position where the first alignment plate 51*a* and the second alignment plate 51*b*, which have moved in the direction orthogonal to the sheet transport direction with reference to the center of the processing tray 221, align the sheets S. Further, the distance between the first alignment plate 51*a* and the second alignment plate 51*b* at the first alignment position is preset slightly longer than the length of the sheets S to be aligned in the width direction.

The second alignment position is the position where the first alignment plate 51*a* and the second alignment plate 51*b*, which have moved in the direction orthogonal to the sheet transport direction with reference to the center of the processing tray 221, align the sheets S. Further, the distance between the first alignment plate 51*a* and the second alignment plate 51*b* at the second alignment position is preset the same as or slightly shorter than the length of the sheets S to be aligned in the width direction.

It should be noted that, with reference to FIG. 16, the X coordinate value=0 indicates the center of the processing tray 221. Further, at the standby position, the first alignment position, and the second alignment position, the first alignment plate 51*a* and the second alignment plate 51*b* are symmetric about the center of the processing tray 221.

To illustrate the respective positions of the first alignment plate 51*a* and the second alignment plate 51*b*, FIG. 16, in the lower part, shows values −X3, −X2, −X1, X1, X2, and X3 with reference to the center (X coordinate=0) of the processing tray 221. Further, Table 1 shows the X coordinate values when the first alignment plate 51*a* and the second alignment plate 51*b* are placed at each operation position. It should be noted that the center of the processing tray 221 has the X coordinate value=0. Further, X1, X2, and X3 have a relationship represented by X1<X2<X3.

TABLE 1

| Position | Member | Position of X coordinate in FIG. 16 |
|---|---|---|
| Standby position | First alignment plate | X3 |
| | Second alignment plate | −X3 |
| First alignment position | First alignment plate | X2 |
| | Second alignment plate | −X2 |
| Second alignment position | First alignment plate | X1 |
| | Second alignment plate | −X1 |

Specifically, when the lateral alignment member 51 is at "the standby position", the X coordinate value of the first alignment plate 51*a* is X3, and the X coordinate value of the second alignment plate 51*b* is −X3.

When the lateral alignment member 51 is at the first alignment position, the X coordinate value of the first alignment plate 51*a* is X2, and the X coordinate value of the second alignment plate 51*b* is −X2. The first alignment plate 51*a* and the second alignment plate 51*b* at the first alignment position are closer to the center of the processing tray 221 than they are at the standby position. The first alignment plate 51*a* and the second alignment plate 51*b* facing each other come in contact with the plurality of sheets S at the first alignment position, and align the ends of the sheets in the sheet width direction.

When the lateral alignment member 51 is at the second alignment position, the X coordinate value of the first alignment plate 51*a* is X1, and the X coordinate value of the second alignment plate 51*b* is −X1. At the second alignment position, the first alignment plate 51*a* and the second alignment plate 51*b* are symmetric about the center of the processing tray 221, and are closer to the center of the processing tray 221 than they are at "the standby position" and than they are at "the first alignment position". The first alignment plate 51*a* and the second alignment plate 51*b* facing each other come in contact with the plurality of sheets S at "the second alignment position", and further align the ends of the sheets in the sheet width direction.

Figure 17:
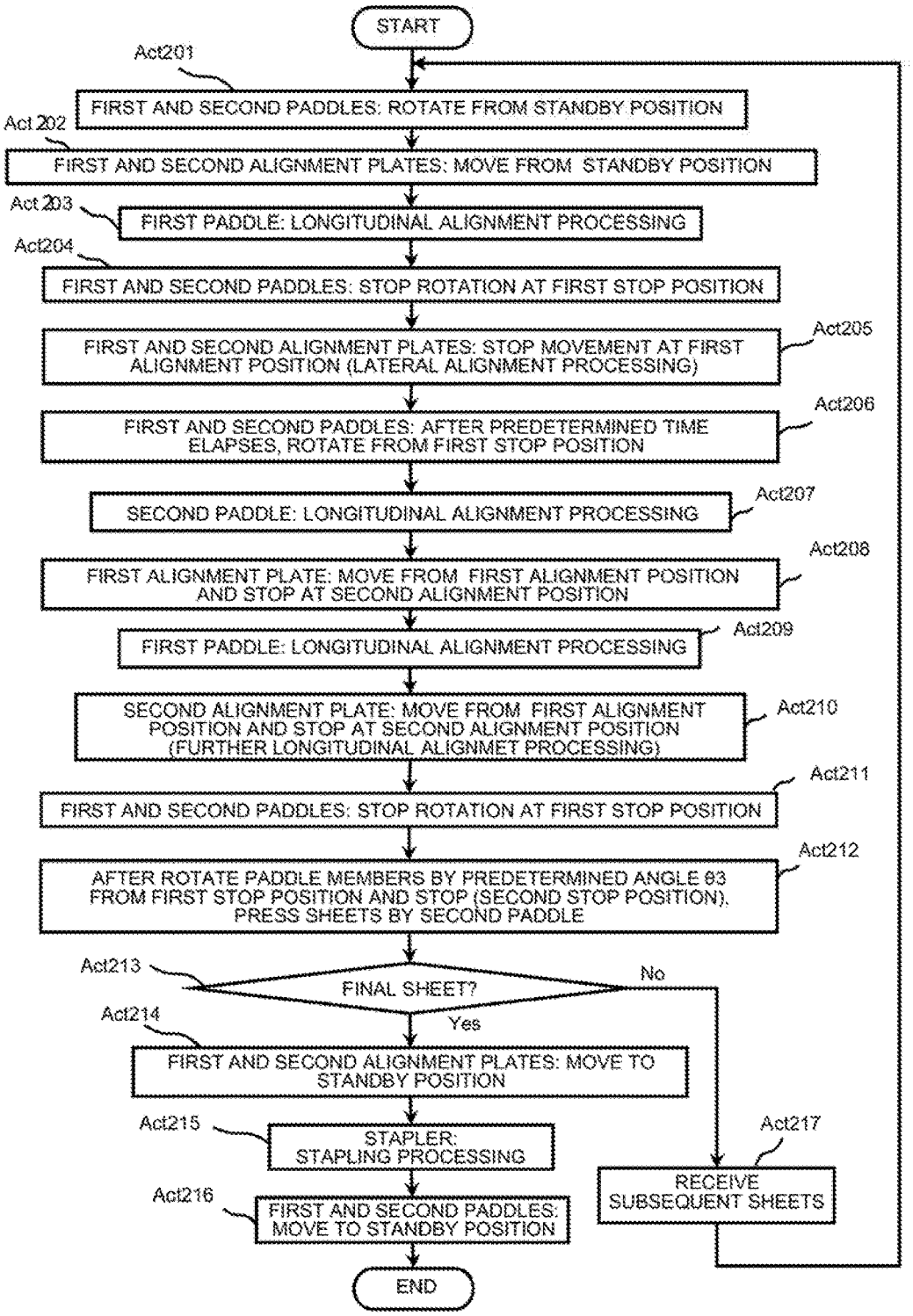
FIG. 17 is a flowchart showing a control executed by a post-processing controller of the sheet post-processing apparatus according to the second embodiment.

FIG. 17 is a flowchart showing a sheet press operation of the paddle members 25 executed by the post-processing controller 24. It should be noted that the description common to the first embodiment will be simplified.

First, when the plurality of sheets S are retained on the standby tray 211 in Act201, the post-processing controller 24 drives the first tray member 211*a* and the second tray member 211*b* to separate from each other. The plurality of sheets S move from the standby tray 211 to the processing tray 221. Further, the post-processing controller 24 rotates the paddle members 25 from the standby position (see FIG. 6). The paddle members 25 is driven by the paddle motor 28 to start to rotate in the arrow-A direction. The first paddle 25*a* comes in contact with the sheet that moves from the standby tray 211 to the processing tray 221 (see FIG. 7).

Next, the post-processing controller 24 drives the first alignment plate 51*a* and the second alignment plate 51*b* in Act202. The first alignment plate 51*a* and the second alignment plate 51*b*, which are at the standby position of the lateral alignment member described above, start to move to the first alignment position.

In Act203, the post-processing controller 24 keeps on rotating the paddle members 25 to allow the first paddle 25*a* to execute the longitudinal alignment processing, as shown in FIG. 8.

In Act204, when the post-processing controller 24 determines that the paddle members 25 rotate by the predetermined angle θ1, then the post-processing controller 24 stops the rotation of the paddle members 25. The first paddle 25*a* and the second paddle 25*b* stop at the first stop position, where the first paddle 25*a* and the second paddle 25*b* are separated from the processing tray 221 (see FIG. 9).

In Act205, the post-processing controller 24 stops the first alignment plate 51*a* and the second alignment plate 51*b* at the first alignment position. Here, the paddle members 25 are separated from the plurality of sheets S on the processing tray 221. Thus, the first alignment plate 51*a* and the second alignment plate 51*b* can execute the lateral alignment processing with being unaffected by the paddle members 25.

In Act206, the post-processing controller 24 determines that the predetermined time elapses after the rotation of the paddle members 25 are stopped, and then rotates again the paddle members 25 in the arrow-A direction.

In Act207, the post-processing controller 24 allows the second paddle 25*b* to execute the longitudinal alignment processing, as shown in FIG. 10. Here, the first alignment plate 51*a* and the second alignment plate 51*b* are placed at the first alignment position. As a result, the sheets may not be misaligned in the sheet width direction when the longitudinal alignment processing is performed by using the second paddle 25*b*.

In Act208, the post-processing controller 24 moves the second alignment plate 51*b* from the first alignment position to the second alignment position, and stops the second alignment plate 51*b* when it reaches the second alignment position.

Further, in Act208, the post-processing controller 24 keeps on rotating the paddle members 25. In Act209, the post-processing controller 24 allows the first paddle 25*a* to execute again the longitudinal alignment processing on the sheets S on the processing tray 221 (see FIG. 11).

In Act210, the post-processing controller 24 moves the first alignment plate 51*a* from the first alignment position to the second alignment position, and stops the first alignment plate 51*a* when it reaches the second alignment position. The first alignment plate 51*a* and the second alignment plate 51*b* facing each other come in contact with the plurality of sheets S, and execute further the lateral alignment processing.

Next, in Act211, when the post-processing controller 24 determines that the paddle members 25 rotate by the predetermined angle θ2 from the standby position (see FIG. 6), the post-processing controller 24 stops the rotation of the paddle members 25. The rotating first paddle 25*a* and second paddle 25*b* stop again at the first stop position (see FIG. 9).

Next, in Act212, after the predetermined time elapses, the post-processing controller 24 rotates the paddle members 25 by the predetermined angle θ3 from the first stop position (see FIG. 9), and stops the paddle members 25 at the second stop position where the sheets S are pressed. At the second stop position, the end of the second paddle 25*b* comes in contact with the sheets on the processing tray 221. The second paddle 25*b* is formed of an elastic material, and thus presses the plurality of sheets S on the processing tray 221 while it is in the bent state (see FIG. 12). It should be noted that the first paddle 25*a* is at the second stop position, where the transport of the subsequent sheets S is not hindered (see FIGS. 12 and 13).

In Act213, the post-processing controller 24 determines whether or not the sheet processed in Act212 is the final sheet. When the post-processing controller 24 determines that the sheet processed in Act212 is not the final sheet (No in Act213), the processing of the post-processing controller 24 proceeds to Act217. In Act217, the post-processing controller 24 moves the first alignment plate 51*a* and the second alignment plate 51*b* until they reach the standby position (see FIG. 10). Then the post-processing controller 24 stands by for receiving the subsequent sheets S' on the processing tray 221. The subsequent processing of the post-processing controller 24 is similar to that in Act201 to Act213 described above, and description thereof is therefore omitted.

In Act212, when the post-processing controller 24 determines that the sheet processed in Act212 is the final sheet (Yes in Act213), processing of the post-processing controller 24 proceeds to Act214. In Act214, the post-processing controller 24 moves the first alignment plate 51*a* and the second alignment plate 51*b* toward the standby position (see FIG. 10) in order to execute stapling processing by the stapler 222. The first alignment plate 51*a* and the second alignment plate 51*b* move from the second alignment position to the standby position.

Here, the distance between the first alignment plate 51*a* and the second alignment plate 51*b* at the second alignment position is set slightly shorter than the length of the sheets S to be aligned in the width direction. Thus, when the first alignment plate 51*a* and the second alignment plate 51*b* execute the lateral alignment processing on the sheets S, the sheets are bent temporarily. When the first alignment plate 51*a* and the second alignment plate 51*b* are separated from the sheets S after the lateral alignment processing, the aligned sheets may sometimes be misaligned by a restoring force of the sheets. However, since the second paddle 25*b* presses the sheets S on the processing tray 221, the aligned sheets S may not to be misaligned.

In Act215, the post-processing controller 24 controls the stapler 222 to execute stapling processing on the plurality of sheets S pressed by the second paddle 25*b*. The stapler 222 can execute the stapling processing where the second paddle 25*b* presses the sheets S on the processing tray 221, and the bundle of the well-aligned sheets may thus be obtained.

In Act216, after the stapling processing is executed, the post-processing controller 24 rotates the paddle members 25 to the standby position (see FIG. 6). As a result, a series of operations is completed.

According to the second embodiment, the stapling processing is executed where the second paddle 25*b* presses the sheets S on the processing tray 221, and the bundle of the well-aligned sheets may thus be obtained. Further, after the longitudinal alignment processing and the lateral alignment processing are executed a plurality of times, the sheets may be still aligned well since the second paddle 25 presses the sheets.

Further, as shown in FIG. 16, the rear ends of the sheets are pressed by the plurality of second paddles 25*b* attached along the rotating shaft 26. Even if any external force is applied to the sheets, the aligned sheets are not to be misaligned.

Next, with reference to FIG. 18, a third embodiment will be described. According to the third embodiment, the stapling processing is executed at one spot or two spots by the stapler 222 where the plurality of sheets S on the processing tray 221 are pressed by the paddle members 25.

It should be noted that the processing in Act201 to Act213 executed by the post-processing controller 24 of the third embodiment is the same as that of the second embodiment, and processing on and after Act214 of the third embodiment is different that of the second embodiment.

Figure 18:
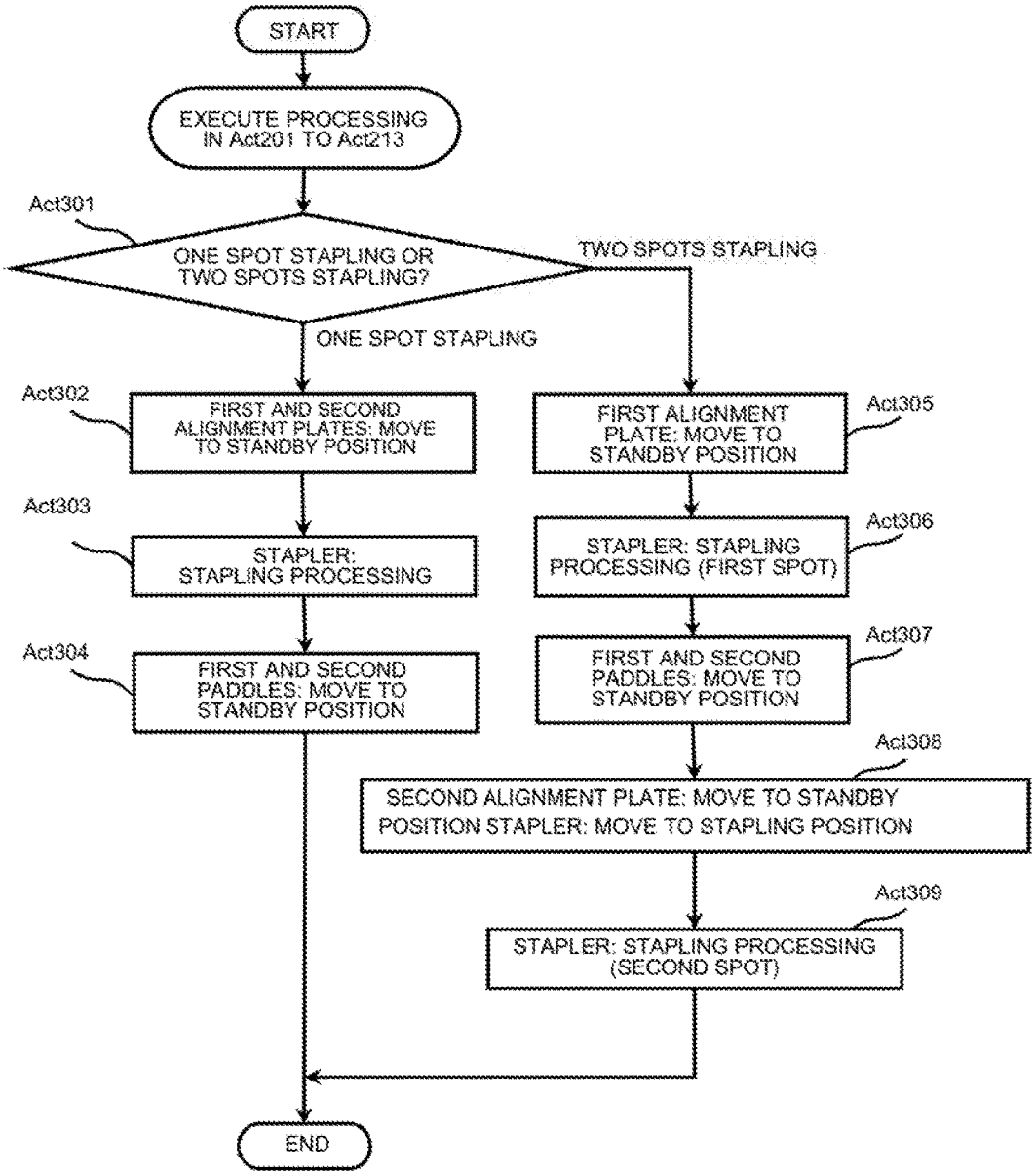
FIG. 18 is a flowchart showing a control executed by a post-processing controller of a sheet post-processing apparatus according to a third embodiment.

FIG. 18 is a flowchart showing an operation of the stapling processing at one spot or two spots executed by the stapler 222 controlled by the post-processing controller 24. The processing in Act201 to Act213 is common to the second embodiment, and description thereof is therefore omitted.

After the processing in Act201 to Act213 is executed, the post-processing controller 24 determines whether a job instructed by the image-forming controller 16 is a stapling job at one spot or a stapling job at two spots in Act301.

When the post-processing controller 24 determines that the job instructed by the image-forming controller 16 is the stapling job at one spot (stapling at one spot in Act301), the processing of the post-processing controller 24 proceeds to Act302. In Act302, the post-processing controller 24 moves the first alignment plate 51*a* to the standby position.

In Act303, the post-processing controller 24 allows the stapler 222 to execute the stapling processing.

In Act304, the post-processing controller 24 moves the paddle members 25 until the paddle members 25 reach the standby position (see FIG. 6), and discharges the bundle of the sheets stapled at one spot to the movable tray 23*b*. A series of processing is completed.

When the post-processing controller 24 determines that the job instructed by the image-forming controller 16 is the stapling job at two spots (stapling at two spots in Act301), the processing of the post-processing controller 24 proceeds to Act305. In Act305, the post-processing controller 24 moves the first alignment plate 51*a* to the standby position.

In Act306, the post-processing controller 24 allows the stapler 222 to execute the stapling processing on the plurality of sheets S at the first spot.

In Act307, the post-processing controller 24 moves the paddle members 25 to the standby position (see FIG. 6).

As a result, it is possible to execute promptly the processing on next sheets after the stapling processing is completed, which contributes to enhance the total processing speed of the sheet post-processing apparatus. Further, since the stapling processing is executed at the first spot in Act306, the plurality of aligned sheets S are not misaligned largely even if the sheets S are not pressed by the buddle members 25.

In Act308, the post-processing controller 24 moves the second alignment plate 51*b* to the standby position.

Further, in Act308, the post-processing controller 24 moves the stapler 222 to the second stapling processing spot.

Next, in Act309, the post-processing controller 24 controls the stapler 222 to execute the stapling processing at the second spot. The stapler 222 executes the stapling processing at the second spot on the bundle of the sheets, on which the stapling processing has been executed at the first spot. After that, the post-processing controller 24 discharges the bundle of the sheets stapled at the two spots to the movable tray 23*b*. A series of processing is completed.

It should be noted that, description has been made in the first to third embodiments with reference to an example in which the sheets on the processing tray 221 are pressed by the second paddle 25*b*. However, the scope of the present invention is not limited thereto. Thus, the sheets on the processing tray 221 may alternatively be pressed by the first paddle 25*a*. When the first paddle 25*a* presses the sheets on the processing tray 221, it is no need to execute the alignment processing by using the first paddle 25*a* for a plurality of times, which contributes to enhance the total processing speed of the sheet post-processing apparatus.

Further, in the first to third embodiments, the puddle member is rotated twice. However, the embodiment is not limited thereto. Specifically, after the longitudinal alignment processing is executed on the sheets on the processing tray 221 by using the first paddle 25*a*, the sheets on which the longitudinal alignment processing is applied may be pressed by the second paddle 25*b*. In this case, it contributes to further enhance the total processing speed of the sheet post-processing apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet post-processing apparatus, comprising:

a transport roller configured to transport sheets;

a processing tray configured to hold the sheets transported by the transport roller;

a stopper that is disposed on an upstream side of the processing tray in a sheet transport direction;

a paddle member having a first and a second paddle configured to rotate around a rotating shaft, the rotating shaft being disposed in a sheet width direction of the sheets held on the processing tray, the sheet width direction being orthogonal to the sheet transport direction, the first and the second paddle of the rotating paddle member configured to alternately press the sheets held on the processing tray against the stopper and align ends of the sheets misaligned in the sheet transport direction, the second paddle having a length shorter than the first paddle; and a controller configured to stop rotation of the paddle member in a state that the second paddle of the paddle member comes in contact with the sheets held on the processing tray, and drive the transport roller to transport subsequent sheets to the processing tray.

2. The sheet post-processing apparatus according to claim 1, wherein the controller is configured to:

rotate the paddle member from a standby position where transport of the sheets is not hindered when the sheets are transported to the processing tray, and control the paddle member such that the first paddle comes in contact with the sheets and applies a force on the sheets to move toward the processing tray.

3. The sheet post-processing apparatus according to claim 2, wherein the controller is configured to:

further rotate the paddle member, control the paddle member such that the first paddle presses the sheets against the stopper and aligns the ends of the sheets misaligned in the sheet transport direction.

4. The sheet post-processing apparatus according to claim 3, wherein after the ends of the sheets misaligned in the sheet transport direction are aligned, the controller is configured to stop the rotation of the paddle member at a first stop position where the first and the second paddle do not come in contact with the sheets held on the processing tray.

5. The sheet post-processing apparatus according to claim 4, wherein the controller is configured to:

after the controller stops the rotation of the paddle member at the first stop position and a predetermined time elapses, rotate again the paddle member, and control the paddle member such that the second paddle presses the sheets against the stopper and aligns again the ends of the sheets misaligned in the sheet transport direction.

6. The sheet post-processing apparatus according to claim 5, wherein the controller is configured to:

rotate the paddle member from the first stop position by a predetermined angle, and then stops the rotation of the paddle member at a second stop position, and control the paddle member to press the sheets in a state that the second paddle of the paddle member is in contact with the sheets held on the processing tray at the second stop position.

7. A sheet post-processing apparatus, comprising:

a transport roller configured to transport sheets;

a processing tray configured to hold the sheets transported by the transport roller;

a stopper that is disposed on an upstream side of the processing tray in a sheet transport direction;

a paddle member having a first and a second paddle configured to rotate around a rotating shaft, the rotating shaft being extended in a sheet width direction of the sheets held on the processing tray, the sheet width direction being orthogonal to the sheet transport direction, the first and the second paddle of the rotating paddle member configured to alternately align ends of the sheets in the sheet transport direction where the sheets held on the processing tray come in contact with the stopper, the second paddle having a length shorter than the first paddle;

a stapler configured to execute stapling processing on the sheets on the processing tray; and a controller configured to stop rotation of the paddle member in a state that the second paddle of the paddle member comes in contact with the sheets on the processing tray, and operate the stapler to execute the stapling processing on the sheets that are in contact with the paddle member.

8. The sheet post-processing apparatus according to claim 7, further comprising:

a lateral alignment member provided for the processing tray, the lateral alignment member including two portions, a predetermined distance being provided between the two portions, the two portions facing each other and coming in contact with the sheets on the processing tray, the lateral alignment member aligning the ends of the sheets in the sheet width direction orthogonal to the sheet transport direction, wherein after the lateral alignment member aligns the ends of the sheets in the sheet width direction, the controller stops the rotation of the paddle member in a state that the second paddle of the paddle member is in contact with the sheets held on the processing tray.

9. The sheet post-processing apparatus according to claim 8, wherein the lateral alignment member includes a first alignment plate and a second alignment plate that are movable in the sheet width direction, and after the second paddle of the paddle member comes in contact with the sheet held on the processing tray, the controller moves the first alignment plate and the second alignment plate in separating directions.

* * * * *